US005780216A

United States Patent [19]

Ihama

[11] Patent Number: 5,780,216

[45] Date of Patent: Jul. 14, 1998

[54] SILVER HALIDE PHOTOGRAPHIC EMULSION

[75] Inventor: Mikio Ihama, Minami-ashigara, Japan

[73] Assignee: Fuji Photo Film Co., Ltd., Kanagawa, Japan

[21] Appl. No.: 649,101

[22] Filed: May 17, 1996

[30] Foreign Application Priority Data

May 19, 1995 [JP] Japan ..... 7-121497

[51] Int. Cl.[6] ..... G03C 1/005

[52] U.S. Cl. ..... 430/567; 430/569

[58] Field of Search ..... 430/567, 569

[56] References Cited

U.S. PATENT DOCUMENTS

| | | | |
|---|---|---|---|
| 4,614,711 | 9/1986 | Sugimoto et al. . | |
| 4,668,614 | 5/1987 | Takada et al. . | |
| 4,692,400 | 9/1987 | Kumashiro et al. | 430/567 |
| 5,591,570 | 1/1997 | Takiguchi et al. | 430/567 |

FOREIGN PATENT DOCUMENTS 0 202 784 B1 11/1986 European Pat. Off. .

*Primary Examiner*—Thorl Chea

*Attorney, Agent, or Firm*—Birch, Stewart, Kolasch & Birch, LLP

[57] ABSTRACT

A silver halide photographic emulsion contains silver iodobromide tabular grains with a quintuple structure in which the amount of silver in a core is 20 to 50% of the total silver amount, the average silver iodide content of the core is 0 to 5 mol %, the amount of silver in a first shell is 5 to 30% of the total silver amount, the average silver iodide content of the first shell is 15 to 40 mol %, the amount of silver in a second shell is 10 to 30% of the total silver amount, the average silver iodide content of the second shell is 0 to 5 mol %, the amount of silver in a third shell is 1 to 10% of the total silver amount, the average silver iodide content of the third shell is 20 to 100 mol %, the amount of silver in a fourth shell is 10 to 40% of the total silver amount, and the average silver iodide content of the fourth shell is 0 to 5 mol %.

16 Claims, No Drawings

SILVER HALIDE PHOTOGRAPHIC EMULSION

BACKGROUND OF THE INVENTION

1. Field of the Invention

The present invention relates to a silver halide photographic emulsion, and more particularly, to a silver halide photographic emulsion containing tabular grains.

2. Description of the Related Art

To improve the sensitivity/granularity ratio, the sensitivity/fog ratio, and the characteristics to pressure of a silver halide photographic emulsion, some structures are given to an internal silver iodide distribution of a silver halide grain.

U.S. Pat. No. 4,668,614 has disclosed that the sensitivity/granularity ratio is improved by a double structure grain in which a core portion has a high silver iodide content and a shell portion has a low silver iodide content. U.S. Pat. No. 4,614,711 has disclosed that the sensitivity/granularity ratio and the characteristics to pressure are improved by a triple structure grain in which a core portion has a low silver iodide content, an intermediate shell has a high silver iodide content, and a shell portion has a low silver iodide content. European Patent No. 202784B has disclosed that the sensitivity/granularity ratio and the sensitivity/fog ratio are improved by a quadruple structure which further includes another intermediate shell having an intermediate silver iodide content between the high silver iodide content of the intermediate shell and the low silver iodide content of the shell portion, at the position between the intermediate shell having the high silver iodide content and the shell having the low silver iodide content of the triple structure grain.

The research and development, however, are still being done to further improve the sensitivity/granularity ratio, the sensitivity/fog ratio, and the characteristics to pressure.

SUMMARY OF THE INVENTION

It is an object of the present invention to provide a silver halide photographic emulsion having a high sensitivity/granularity ratio, a high sensitivity/fog ratio, and high characteristics to pressure. If it another object of the present invention to provide a silver halide photographic emulsion also having good reciprocity characteristics.

DETAILED DESCRIPTION OF THE PREFERRED EMBODIMENTS

The above objects of the present invention are achieved by emulsions described below which contain quintuple structure silver halide grains in which the silver iodide content and the silver amount of each portion of a grain are defined.

That is, the above objects are achieved by a silver halide photographic emulsion comprising silver iodobromide tabular grains having (111) faces as parallel major faces and having an aspect ratio of not less than 2 in an amount of not less than 50% of the total projected area of the emulsion, wherein each tabular grain has a core and multi-layered shell structure around the core, wherein said shell structure comprising a first shell on the core, a second shell on the first shell, a third shell on the second shell, and a fourth shell on the third shell, said core having a silver amount of 20 to 50 mol % of the total silver amount in the grain, and an average silver iodide content of 0 to 5 mol %, said first shell having a silver amount of 5 to 30 mol % of the total silver amount in the grain, and an average silver iodide content of 15 to 40 mol %, said second shell having a silver amount of 10 to 30 mol % of the total silver amount in the grain, and an average silver iodide content of 0 to 5 mol %, said third shell having a silver amount of 1 to 10 mol % of the total silver amount in the grain, and an average silver iodide content of 20 to 100 mol %, and said fourth shell having a silver amount of 10 to 40 mol % of the total silver amount in the grain, and an average silver iodide content of 0 to 5 mol %, and a silver halide photographic emulsion comprising silver iodobromide tabular grains having (111) faces as parallel major faces and having an aspect ratio of not less than 2 in an amount of not less than 50% of the total projected area of the emulsion, wherein each tabular grain has a core and multi-layered shell structure around the core, wherein said shell structure comprising a first shell on the core, a second shell on the first shell, a third shell on the second shell, and a fourth shell on the third shell, said core having a silver amount of 25 to 45 mol % of the total silver amount in the grain, and an average silver iodide content of 0 to 3 mol %, said first shell having a silver amount of 10 to 25 mol % of the total silver amount in the grain, and an average silver iodide content of 20 to 35 mol %, said second shell having a silver amount of 15 to 25 mol % of the total silver amount in the grain, and an average silver iodide content of 0 to 3 mol %, said third shell having a silver amount of 1 to 8 mol % of the total silver amount in the grain, and an average silver iodide content of 25 to 100 mol %, and said fourth shell having a silver amount of 15 to 35 mol % of the total silver amount in the grain, and an average silver iodide content of 0 to 3 mol %.

The characteristic features of the present invention are that two layered shells having high iodide content are present apart from each other inside a silver halide grain, and that the above objects are achieved by defining the position inside a silver halide grain, the silver amount, and the silver iodide content of each of the two layered shells.

The present invention will be described in detail below.

The emulsion of the present invention is a silver halide emulsion in which 50% or more of a total projected area are occupied by silver iodobromide tabular grains containing (111) faces as parallel major faces and having an aspect ratio of 2 or more. A tabular grain has parallel opposing (111) major faces and side faces connecting these major faces. The side face can be a (111) face, a (100) face, or a mixture of these faces, and can also contain higher-index faces.

A tabular grain emulsion described in European Patent No. 515894A1 in which the ratio of (111) faces in side faces is low is preferably used. At least one twin plane is present between the (111) major faces, and two twin planes are usually observed. The spacing between these two twin planes can be decreased to be smaller than 0.012 μm as described in U.S. Pat. No. 5,219,720. Also, as described in Jpn. Pat. Appln. KOKAI Publication No. (hereinafter referred to as JP-A-) 5-249585, the value obtained by dividing the distance between the (111) major faces by the distance between the two twin planes can be increased to 15 or more.

In the emulsion of the present invention, 50% or more, preferably 60% or more, and most preferably 70% or more of a total projected area are occupied by tabular grains having an aspect ratio of 2 or more. The higher the aspect ratio, the more remarkable the effect of the present invention. Therefore, in the tabular grain emulsion 50% or more of the total projected area are occupied by grains having an aspect ratio of preferably 5 or more, and most preferably 6 or more. If the aspect ratio is too high, the variation coefficient of a grain size distribution tends to increase. Accordingly, it is usually preferable that the aspect ratio be 20 or less.

The projected area and the aspect ratio of a tabular grain can be measured from an electron micrograph obtained by shadowing the tabular grain together with a reference latex sphere by using a carbon replica method. The major face of a tabular grain commonly has the shape of a hexagon, a triangle, or a circle. An aspect ratio is the value obtained by dividing the diameter of a circle having an area equal to the projected area of a tabular grain by the thickness of the grain. As the shape of the major face of a tabular grain, the ratio of hexagons is preferably as high as possible. Also, the ratio of the lengths of adjacent sides of a hexagon is preferably 1:2 or less.

The variation coefficient of a grain size distribution is preferably 20% or less, and most preferably 15% or less.

The emulsion of the present invention comprises silver iodobromide grains. Although the emulsion can comprise a grain in which silver chloride is contained, the total silver chloride content of the emulsion is preferably 8 mol % or less, and more preferably 3 mol % or less or 0 mol %. The total silver iodide content of the emulsion is preferably 5 to 20 mol %, and most preferably 7 to 15 mol %. The variation coefficient of a silver iodide content distribution between grains is preferably 20% or less, and most preferably 10% or less.

The tabular grain of the present invention can have a quintuple structure comprising a core and multi-layered shell structure around the core. The shell structure comprise a first shell, a second shell, a third shell, and a fourth shell in this order from a central portion. The tabular grain can also have higher-order structure such as sextuple or more structure provided that the silver iodide contents in the core and each shell, and the amounts of silver in the core and each shell basically satisfy the relationships to be described later. If these values of the silver iodide content and the amount of silver do not satisfy the relationships, the effect of the present invention cannot be obtained even with multi-layered shell structure. In the present invention, formation of the core, the first shell, the second shell, the third shell, and the fourth shell correspond to the time sequence of the preparation of silver halide grains. The individual preparation steps for forming the core and each shell can be continuously performed in this order, or washing and dispersion steps can be performed between the steps. That is, after the core is prepared, it is possible to perform washing and dispersion and form the first, second, third, and fourth shells by using the prepared core grain emulsion as a seed emulsion. Likewise, an emulsion having the core grain covered with the first shell can be used as a seed emulsion.

In the tabular grain of the present invention, each of the average silver amounts indicated by mol % in the core, the first shell, the second shell, the third shell, and the fourth shell, based on the total silver amount in the grain, are so selected that the relationships to be described later are satisfied, and preferably, the sum of the ratios of the silver amount of the core and the first to the fourth shells is exactly 100 mol %.

In the present invention, the silver amount in the core of the tabular grain is 20 to 50 mol % of the total silver amount in the grain, and the average silver iodide content in the core is 0 to 5 mol %.

The ratio of the silver amount in the core to the total silver amount in the grain can conveniently be obtained by the ratio of the silver amount added to prepare the core to the silver amount added to obtain a final grain. The average silver iodide content of the core can conveniently be obtained by the ratio in mol % of the silver iodide amount added to prepare the core to the silver amount added to prepare the core. The above calculations to obtain the silver amount and the average silver iodide content are based on the presumption that all the silver and all the iodide added are incorporated in the grains prepared. The distribution of silver iodide in the core can be either uniform or nonuniform. The silver amount in the core is preferably 25 to 45 mol % of the total silver amount, and the average silver iodide content in the core is preferably 0 to 3 mol %. The core can be prepared by various methods.

For example, the core can be prepared by methods described in Cleve, "Photography Theory and Practice (1930)", page 131; Gutoff, "Photographic Science and Engineering", Vol. 14, pp. 248 to 257 (1970); and U.S. Pat. Nos. 4,434,226, 4,414,310, 4,433,048, and 4,439,520, and British Patent No. 2,112,157.

The preparation of the core basically comprises three steps, nucleation, ripening, and growth. The methods described in U.S. Pat. No. 4,797,354 and JP-A-2-838 are very effective in the preparation of the core of the present invention.

In the nucleation step of the present invention, it is extremely effective to use gelatin with a small methionine content described in U.S. Pat. Nos. 4,713,320 and 4,942,120, perform nucleation with a high pBr as described in U.S. Pat. No. 4,914,014, and perform nucleation within a short time period as described in JP-A-2-222940. In the ripening step for preparing the tabular grains of the present invention, it is sometimes effective to perform ripening in the presence of a low-concentration base as described in U.S. Pat. No. 5,254,453 or at a high pH as described in U.S. Pat. No. 5,013,641.

Tabular grain formation methods using polyalkyleneoxide compounds described in U.S. Pat. Nos. 5,147,771, 5,147,772, 5,147,773, 5,171,659, 5,210,013, and 5,252,453 are preferably used in the preparation of the core of the tabular grain of the present invention.

The first shell is formed on the core tabular grain described above. The silver amount in the first shell is 5 to 30 mol % of the total silver amount of the grain, and the average silver iodide content in the first shell is 15 to 40 mol %. The silver amount in the first shell is preferably 10 to 25 mol % of the total silver amount of the grain, and the average silver iodide content in the first shell is preferably 20 to 4 35 mol %. The growth of the first shell on the core tabular grain can be done in either of a direction in which the aspect ratio of the core tabular grain is increased or in a direction in which it is decreased. The growth of the first shell is basically done by adding an aqueous silver nitrate solution and an aqueous halide solution containing iodide and bromide by using a double-jet method. Preferably, the aqueous halide solution containing iodide and bromide is diluted with respect to the aqueous silver nitrate solution. The temperature and pH of the system, the type and concentration of a protective colloid agent such as gelatin, and the presence/absence, type, and concentration of a silver halide solvent can vary over a broad range.

The pBr during the growth of the first shell is preferably 2.5 or less, and more preferably 2 or less. Assuming all (100%) iodine ions react with silver ions and the remaining silver ions react with bromine ions, the pBr means the logarithm of the reciprocal of a bromine ion concentration in the system before the reaction.

Instead of adding the aqueous silver nitrate solution and the aqueous halide solution containing iodide and bromide by using the double-jet method, it is also possible and effective to simultaneously add an aqueous silver nitrate solution, an aqueous halide solution containing bromide, and a silver iodide fine grain emulsion, as described in U.S. Pat. Nos. 4,672,027 and 4,693,964. The first shell can also be formed by adding a silver iodobromide fine grain emulsion and ripening thereof. If this is the case, the use of a silver halide solvent is particularly preferable.

Examples of the silver halide solvent usable in the present invention are (a) organic thioethers described in U.S. Pat. Nos. 3,271,157, 3,531,286, and 3,574,628, and JP-A-54-1019 and JP-A-54-158917, (b) thiourea derivatives described in JP-A-53-82408, JP-A-55-77737, and JP-A-55-2982, (c) silver halide solvents having a thiocarbonyl group sandwiched between an oxygen or sulfur atom and a nitrogen atom described in JP-A-53-144319, (d) imidazoles described in JP-A-54-100717, (e) sulfite, (f) ammonia, and (g) thiocyanate.

Particularly preferable solvents are thiocyanate, ammonia, and tetramethylthiourea. Although the amount of the solvent used changes in accordance with the type of the solvent, a preferable amount is, in the case of, e.g., thiocyanate, $1\times10^{-4}$ to $1\times10^{-2}$ mol per mol of silver halide.

When any of these solvents is used, it is basically possible to remove the solvent by providing a washing step after the first shell formation step as described previously.

The second shell is formed on the tabular grain having the core and the first shell described above. The silver amount in the second shell is 10 to 30 mol % of the total silver amount of the grain, and the average silver iodide content in the second shell is 0 to 5 mol %. The silver amount in the second shell is preferably 15 to 25 mol % of the total silver amount in the grain, and the average silver iodide content in the second shell is preferably 0 to 3 mol %. The growth of the second shell on the tabular grain having the core and the first shell can be done in either of a direction in which the aspect ratio of the tabular grain is increased or in a direction in which it is decreased. The growth of the second shell is basically done by adding an aqueous solution of silver nitrate and an aqueous halide solution containing bromide by using a double-jet method. Alternatively, after the aqueous halide solution containing bromide is added, the aqueous silver nitrate solution can be added by a single-jet method. The aqueous halide solution can further contain iodide, if it is desired to prepare the second shell containing silver iodobromide. The temperature and pH of the system, the type and concentration of a protective colloid agent such as gelatin, and the presence/absence, type, and concentration of a silver halide solvent can vary over a broad range.

In the present invention, it is particularly preferable that after the formation of the second shell, 75% or less of all side faces connecting the opposing (111) major faces of the tabular grains be constituted by (111) faces.

"75% or less of all side faces are constituted by (111) faces" means that crystallographic faces other than (111) faces exist at a ratio higher than 25% of all side faces. It is generally understood that the face other than the (111) face is a (100) face, but some other face such as a (110) face or a higher-index face also can exist. The effect of the present invention is remarkable when 70% or less of all side faces are constituted by (111) faces.

Whether 70% or less of all side faces are constituted by (111) faces can be readily determined from a shadowed electron micrograph of the tabular grain obtained by a carbon replica method. When 75% or more of side faces are constituted by (111) faces in a hexagonal tabular grain, six side faces being connected directly to the (111) major faces usually are alternately connected at acute and obtuse angles to the (111) major faces. On the other hand, when 70% or less of all side faces are constituted by (111) faces in a hexagonal tabular grain, all six side faces being directly connected to the (111) major faces are connected at obtuse angles to the (111) major faces. By performing shadowing at an angle of 50° or less, it is possible to distinguish between obtuse and acute angles of side faces with respect to the major faces. Shadowing at an angle of preferably 10° to 30° facilitates distinguishing between obtuse and acute angles.

As the method of obtaining the ratio of (111) faces to (100) faces, in the case where all the side faces consist of (111) faces and (100) faces, a method which uses adsorption of sensitizing dyes is also effective. The ratio of (111) faces to (100) faces can be quantitatively obtained by using the method described in Journal of Japan Chemical Society, 1984, Vol. 6, pp. 942 to 947. By using this ratio and the equivalent-circle diameter and the thickness of a tabular grain, it is possible to calculate the ratio of (111) faces in all side faces. In this case it is assumed that a tabular grain is a circular cylinder whose diameter of the opposing major faces is the equivalent-circle diameter and whose distance between the opposing major faces is the thickness. On the basis of this assumption, the ratio of side faces to the total surface area can be obtained. The value obtained by dividing the ratio of (100) faces, which is obtained by adsorption of sensitizing dyes as described above, by the ratio of side faces mentioned above, and multiplying the quotient by 100 is the ratio of (100) faces in all side faces. By subtracting this value from 100 the ratio of (111) faces in all side faces can be calculated. In the present invention, it is more preferable that the ratio of (111) faces in all side faces be 65% or less.

A method by which 75% or less of all side faces of the tabular grain emulsion of the present invention are constituted by (111) faces will be described below. Most generally, the ratio of (111) faces in side faces of a silver iodobromide tabular grain emulsion is determined by the pBr during the preparation of the second shell of the tabular grain emulsion. The pBr is preferably so set that the ratio of (111) faces in side faces decreases, i.e., the ratio of (100) faces in side faces increases, during the addition of 30% or more of the silver amount necessary to form the second shell. The pBr is more preferably so set that the ratio of (111) faces in side faces decreases during the addition of 50% or more of the silver amount necessary to form the second shell.

As another method, it is also possible to increase the ratio of (100) faces in side faces by performing ripening by setting a pBr by which the ratio of (100) faces in side faces increases.

The value of the pBr by which the ratio of (100) faces in side faces increases can vary over a broad range in accordance with the temperature and pH of the system, the type and concentration of a protective colloid agent such as gelatin, the presence/absence, type, and concentration of a silver halide solvent. Commonly, the pBr is preferably 2.0 to 5, and more preferably 2.5 to 4.5. As described above, however, the value of the pBr can be easily changed by, e.g., the presence of a silver halide solvent.

European Patent No. 515894A1 can be referred to as a method of changing the face index of a side face of a tabular grain emulsion. Also, polyalkyleneoxide compounds described in, e.g., U.S. Pat. No. 5,252,453 can be used. It is effective to use face index modifiers described in, e.g., U.S.

Pat. Nos. 4,680,254, 4,680,255, 4,680,256, and 4,684,607. Common photographic spectral sensitizing dyes also can be used as face index modifiers.

The third shell is formed on the tabular grain having the core, the first shell, and the second shell described above. The silver amount in the third shell is 1 to 10 mol % of the total silver amount in the grain, and the average silver iodide content in the third shell is 20 to 100 mol %. The silver amount in the third shell is preferably 1 to 8 mol % of the total silver amount in the grain, and the average silver iodide content in the third shell is preferably 25 to 100 mol %. The growth of the third shell on the tabular grain having the core and the first and second shells is basically done by adding an aqueous silver nitrate solution and an aqueous halide solution containing iodide and bromide by using a double-jet method. The growth of the third shell can preferably be done by adding an aqueous silver nitrate solution and an aqueous halide solution containing iodide by a double-jet method. The growth of the third shell can preferably be done by adding an aqueous halide solution containing iodide by a single-jet method. If this is the case, the molar amount of silver in the third shell is the same as that of the halide in the halide solution added by a single-jet method. The molar amount of silver in the second shell becomes the amount subtracting the above molar amount of silver in the third shell from the molar amount of the silver of the second shell which is obtained before the addition of the halide solution by a single-jet method, assuming that halogen conversion of the second shell takes place 100%. Assume that the silver iodide content is 100 mol %.

It is possible to use any of the above methods or combine the methods. As can be seen from the average iodide content of the third shell, silver iodide also can precipitate in addition to a silver iodobromide mixed crystal during the formation of the third shell. In either case, the silver iodide vanishes and entirely changes into a silver iodobromide mixed crystal during the formation of the fourth shell.

As a preferable method for forming the third shell, a method of adding, ripening, and dissolving a silver iodobromide or silver iodide fine grain emulsion is usable.

A more preferable method is to add a silver iodide fine grain emulsion and then add an aqueous silver nitrate solution or both of an aqueous silver nitrate solution and an aqueous halide solution. In this method, the dissolution of the silver iodide fine grain emulsion is accelerated by the addition of average the aqueous silver nitrate solution. In order to obtain the ratio of silver amount in the third shell, the silver amount of the added silver iodide fine grain emulsion is assumed to the amount of silver in the third shell, and the iodide content in this case becomes 100 mol %. The amount of silver contained in the added aqueous silver nitrate solution is assumed to the silver amount in the fourth shell to calculate the average silver amount in the fourth shell. It is preferable that the silver iodide fine grain emulsion be abruptly added.

"Abruptly adding the silver iodide fine grain emulsion" is to add the silver iodide fine grain emulsion within preferably ten minutes, and more preferably seven minutes. This condition can vary in accordance with the temperature, pBr, and pH of the system to be added, the type and concentration of a protective colloid agent such as gelatin, and the presence/absence, type, and concentration of a silver halide solvent. However, a shorter addition time is more preferable as described above. During the addition of the silver iodide fine grain emulsion, it is preferable that an aqueous solution of silver salt such as silver nitrate be not substantially added. The temperature of the system during the addition is preferably 40° to 90° C., and most preferably 50° to 80° C.

The silver iodide fine grain emulsion substantially need only be silver iodide and can contain silver bromide and/or silver chloride as long as a mixed crystal can be formed. The emulsion is preferably 100% silver iodide. The crystal structure of silver iodide can be a β body, a γ body, or, as described in U.S. Pat. No. 4,672,026, an α body or an α body similar structure. In the present invention, the crystal structure is not particularly restricted but is preferably a mixture of β and γ bodies, and more preferably a β body. The silver iodide fine grain emulsion can be either an emulsion formed immediately before being added as described in U.S. Pat. No. 5,004,679 or an emulsion subjected to a regular washing step. In the present invention, an emulsion subjected to a regular washing step is preferably used. The silver iodide fine grain emulsion can be readily formed by a method described in, e.g., U.S. Pat. No. 4,672,026. A double-jet addition method using an aqueous silver salt solution and an aqueous iodide salt solution in which grain formation is performed with a fixed pI value is preferable. The pI is the logarithm of the reciprocal of the $I^-$ ion concentration of the system. The temperature, pI, and pH of the system, the type and concentration of a protective colloid agent such as gelatin, and the presence/absence, type, and concentration of a silver halide solvent are not particularly limited. However, a grain size of preferably 0.1 μm or less, and more preferably 0.07 μm or less is convenient for the present invention. Although the grain shapes cannot be perfectly specified because the grains are fine grains, the variation coefficient of a grain size distribution is preferably 25% or less. The effect of the present invention is particularly remarkable when the variation coefficient is 20% or less. The sizes and the size distribution of the silver iodide fine grain emulsion are obtained by placing silver iodide fine grains on a mesh for electron microscopic observation and directly observing the grains by a transmission method instead of a carbon replica method. This is because measurement errors are increased by observation done by the carbon replica method since the grain sizes are small. The grain size is defined as the diameter of a circle having an area equal to the projected area of the observed grain. The grain size distribution also is obtained by using this equivalent-circle diameter of the projected area. In the present invention, the most effective silver iodide fine grains have a grain size of 0.06 to 0.02 μm and a grain size distribution variation coefficient of 18% or less.

After the grain formation described above, the silver iodide fine grain emulsion is subjected to regular washing described in, e.g., U.S. Pat. No. 2,614,929, and adjustments of the pH, the pI, the concentration of a protective colloid agent such as gelatin, and the concentration of the contained silver iodide are performed. The pH is preferably 5 to 7. The pI value is preferably the one at which the solubility of silver iodide is a minimum or the one higher than that value. As the protective colloid agent, a common gelatin having an average molecular weight of approximately 100,000 is preferably used. A low-molecular-weight gelatin having an average molecular weight of 20,000 or less also is preferably used. It is sometimes convenient to use a mixture of gelatins having different molecular weights. The gelatin amount in the emulsion is preferably 10 to 100 g, and more preferably 20 to 80 g per kg of an emulsion. The silver amount in the emulsion is preferably 10 to 100 g, and more preferably 20 to 80 g, in terms of silver, per kg of an emulsion. With regard to the gelatin amount and/or the silver amount, it is preferable to choose values suited to abrupt addition of the silver iodide fine grain emulsion.

The silver iodide fine grain emulsion is usually dissolved before being added. During the addition it is necessary to sufficiently raise the efficiency of stirring of the system. The rotating speed of stirring is preferably set to be higher than usual. The addition of an antifoaming agent is effective to prevent the formation of foam during the stirring. More specifically, an antifoaming agent described in, e.g., the examples of U.S. Pat. No. 5,275,929 is used.

The fourth shell is formed on the tabular grain having the core, the first shell, the second shell, and the third shell. The silver amount in the fourth shell is 10 to 40 mol % of the total silver amount in the grain, and the average silver iodide content in the fourth shell is 0 to 5 mol %. The silver amount in the fourth shell is preferably 15 to 35 mol % of the total silver amount in the grain, and the average silver iodide content in the fourth shell is preferably 0 to 3 mol %. The growth of the fourth shell on the tabular grain having the core and the first, second, and third shells can be done in either of a direction in which the aspect ratio of the tabular grain is increased or in a direction in which it is decreased. The growth of the fourth shell is basically done by adding an aqueous silver nitrate solution and an aqueous halogen solution containing bromide by using a double-jet method. Alternatively, after the aqueous silver halogen solution containing bromide is added, an aqueous silver nitrate solution can be added by a single-jet method. The aqueous halide solution can further contain iodide, if it is desired to prepare the fourth shell containing silver iodobromide. The temperature and pH of the system, the type and concentration of a protective colloid agent such as gelatin, and the presence/absence, type, and concentration of a silver halide solvent can vary over a broad range. In the present invention, it is preferable that the pBr at the end of formation of the layer be higher than that in the initial stages of formation of the layer. Preferably, the pBr in the early stages of formation of the layer is 2.9 or less, and the pBr at the end of formation of the layer is 1.7 or more. More preferably, the pBr in the early stages of formation of the layer is 2.5 or less, and the pBr at the end of formation of the layer is 1.9 or more. Most preferably, the pBr in the early stages of formation of the layer is 1 to 2.3, and the pBr at the end of formation of the layer is 2.1 to 4.5.

In the present invention, the tabular grain preferably has dislocation lines. The dislocation lines can preferably be found at fringe portions of each tabular grain when the grain is observed from the direction above the major face thereof. Dislocation lines in the tabular grain can be observed by a direct method described in, e.g., J. F. Hamilton, Phot. Sci. Eng., 11, 57, (1967) or T. Shiozawa, J. Soc. Phot. Sci. Japan, 35, 213, (1972), which is performed at a low temperature by using a transmission electron microscope. That is, silver halide grains are carefully extracted from an emulsion so as not to produce a pressure capable of forming dislocation lines in the grains, and are placed on a mesh for electron microscopic observation. The sample is observed by a transmission method while being cooled to prevent damages (e.g., print out) caused by electron rays. In this method, as the thickness of a grain increases, it becomes more difficult to transmit electron rays through it. Therefore, grains can be observed more clearly by using an electron microscope of high voltage type (200 kV or higher for a grain having a thickness of 0.25 μm). A photograph of grains obtained by this method shows the positions and the number of dislocation lines in each grain when the grain is viewed in a direction perpendicular to the major faces.

The average number of dislocation lines is preferably 10 or more, and more preferably 20 or more per grain. If dislocation lines are densely present or cross each other when observed, it is sometimes impossible to accurately count the number of dislocation lines per grain. Even in these situations, however, dislocation lines can be roughly counted to such an extent as in units of ten lines. Accordingly, these cases can be clearly distinguished from cases where only several dislocation lines are present. The average number of dislocation lines per grain is obtained as a number average by counting the dislocation lines of 100 grains or more.

It is advantageous to use gelatin as a protective colloid for use in preparation of emulsions of the present invention or as a binder for other hydrophilic colloid layers. However, another hydrophilic colloid can also be used in place of gelatin.

Examples of the hydrophilic colloid are protein, such as a gelatin derivative, a graft polymer of gelatin and another high polymer, albumin, and casein; a cellulose derivative, such as hydroxyethylcellulose, carboxymethylcellulose, and cellulose sulfates; a sugar derivative such as soda alginate, and a starch derivative; and a variety of synthetic hydrophilic high polymers, such as homopolymers or copolymers, e.g., polyvinyl alcohol, polyvinyl alcohol partial acetal, poly-N-vinylpyrrolidone, polyacrylic acid, polymethacrylic acid, polyacrylamide, polyvinylimidazole, and polyvinylpyrazole.

Examples of gelatin are lime-processed gelatin, acid-processed gelatin, and enzyme-processed gelatin described in Bull. Soc. Sci. Photo. Japan. No. 16, page 30 (1966). In addition, a hydrolyzed product or an enzyme-decomposed product of gelatin can also be used.

It is preferable to wash an emulsion of the present invention for a desalting purpose to disperse into a newly prepared protective colloid. Although the temperature of washing can be selected in accordance with the intended use, it is preferably 5° C. to 50° C. Although the pH of washing can also be selected in accordance with the intended use, it is preferably 2 to 10, and more preferably 3 to 8. The pAg of washing is preferably 5 to 10, though it can also be selected in accordance with the intended use. The washing method can be selected from noodle washing, dialysis using a semipermeable membrane, centrifugal separation, coagulation precipitation, and ion exchange. The coagulation precipitation can be selected from a method using sulfate, a method using an organic solvent, a method using a water-soluble polymer, and a method using a gelatin derivative.

In the preparation of an emulsion of the present invention, it is preferable to make salt of metal ion exist during grain formation, desalting, or chemical sensitization, or before coating in accordance with the intended use. The metal ion salt is preferably added during grain formation in the case where the salt is doped into a grain, and after grain formation and before completion of chemical sensitization in the case where the salt is used as the grain surface modifier or the salt is used as a chemical sensitizer. The doping can be performed for any of an overall grain, only the core, or the shell of a grain. Examples of the metal are Mg, Ca, Sr, Ba, Al, Sc, Y, La, Cr, Mn, Fe, Co, Ni, Cu, Zn, Ga, Ru, Rh, Pd, Re, Os, Ir, Pt, Au, Cd, Hg, Tl, In, Sn, Pb, and Bi. These metals can be added as long as they are in the form of salt that can be dissolved during grain formation, such as ammonium salt, acetate, nitrate, sulfate, phosphate, hydroacid salt, 6-coordinated complex salt, or 4-coordinated complex salt. Examples are $CdBr_2$, $CdCl_2$, $Cd(NO_3)_2$, $Pb(NO_3)_2$, $Pb(CH_3COO)_2$, $K_3[Fe(CN)_6]$, $(NH_4)_4[Fe(CN)_6]$, $K_3IrCl_6$, $(NH_4)_3RhCl_6$, and $K_4Ru(CN)_6$. The ligand of a coordination compound can be selected from halo, aquo, cyano, cyanate, thiocyanate, nitrosyl, thionitrosyl, oxo, and carbonyl. These metal compounds can be used either singly or in the form of a combination of two or more types of them.

The metal compounds are preferably dissolved in water or an appropriate solvent, such as methanol or acetone, and added in the form of a solution. To stabilize the solution, an aqueous halogenated hydrogen solution (e.g., HCl and HBr) or an alkali halide (e.g., KCl, NaCl, KBr, and NaBr) can be added. It is also possible to add acid or alkali if necessary. The metal compounds can be added to a reactor vessel either before or during grain formation. Alternatively, the metal compounds can be added to an aqueous solution of water-soluble silver salt (e.g., $AgNO_3$) or an aqueous alkali halide solution (e.g., NaCl, KBr, and KI) continuously during formation of silver halide grains. Furthermore, a solution of the metal compounds can be prepared independently of a water-soluble salt or an alkali halide and added continuously at a proper timing during grain formation. It is also possible to combine several different addition methods.

It is sometimes useful to perform a method of adding a chalcogen compound during preparation of an emulsion, such as described in U.S. Pat. No. 3,772,031. In addition to S, Se, and Te, cyanate, thiocyanate, selenocyanate, carbonate, phosphate, and acetate can be present.

In formation of silver halide grains of the present invention, at least one of sulfur sensitization, selenium sensitization, gold sensitization, palladium sensitization or noble metal sensitization, and reduction sensitization can be performed at any point during the process of manufacturing a silver halide emulsion. The use of two or more different sensitizing methods is preferable. Several different types of emulsions can be prepared by changing the timing at which the chemical sensitization is performed. The emulsion types are classified into: a type in which a chemical sensitization center is embedded inside a grain, a type in which it is embedded at a shallow position from the surface of a grain, and a type in which it is formed on the surface of a grain. In emulsions of the present invention, the position of a chemical sensitization center can be selected in accordance with the intended use. However, it is preferable to form at least one type of a chemical sensitization speck near the surface.

One chemical sensitization which can be preferably performed in the present invention is chalcogen sensitization, noble metal sensitization, or a combination of these. The sensitization can be performed by using an active gelation as described in T. H. James, The Theory of the Photographic Process, 4th ed., Macmillan, 1977, pages 67 to 76. The sensitization can also be performed by using any of sulfur, selenium, tellurium, gold, platinum, palladium, and iridium, or by using a combination of a plurality of these sensitizers at pAg 5 to 10, pH 5 to 8, and a temperature of 30° to 80° C., as described in Research Disclosure, Vol. 120, April, 1974, 12008, Research Disclosure, Vol. 34, June, 1975, 13452, U.S. Pat. Nos. 2,642,361, 3,297,446, 3,772,031, 3,857,711, 3,901,714, 4,266,018, and 3,904,415, and British Patent 1,315,755. In the noble metal sensitization, salts of noble metals, such as gold, platinum, palladium, and iridium, can be used. In particular, gold sensitization, palladium sensitization, or a combination of the both is preferable. In the gold sensitization, it is possible to use known compounds, such as chloroauric acid, potassium chloroaurate, potassium aurithiocyanate, gold sulfide, and gold selenide. A palladium compound means a divalent or tetravalent salt of palladium. A preferable palladium compound is represented by $R_2PdX_6$ or $R_2PdX_4$ wherein R represents a hydrogen atom, an alkali metal atom, or an ammonium group and X represents a halogen atom, i.e., a chlorine, bromine, or iodine atom.

More specifically, the palladium compound is preferably $K_2PdCl_4$, $(NH_4)_2PdCl_6$, $Na_2PdCl_4$, $(NH_4)_2PdCl_4$, $Li_2PdCl_4$, $Na_2PdCl_6$, or $K_2PdBr_4$. It is preferable that the gold compound and the palladium compound be used in combination with thiocyanate or selenocyanate.

Examples of a sulfur sensitizer are hypo, athiourea-based compound, a rhodanine-based compound, and sulfur-containing compounds described in U.S. Pat. Nos. 3,857,711, 4,266,018, and 4,054,457. The chemical sensitization can also be performed in the presence of a so-called chemical sensitization aid. Examples of a useful chemical sensitization aid are compounds, such as azaindene, azapyridazine, and azapyrimidine, which are known as compounds capable of suppressing fog and increasing sensitivity in the process of chemical sensitization. Examples of the chemical sensitization aid and the modifier are described in U.S. Pat. Nos. 2,131,038, 3,411,914, and 3,554,757, JP-A-58-126526, and G. F. Duffin, Photographic Emulsion Chemistry, pages 138 to 143.

It is preferable to also perform gold sensitization for emulsions of the present invention. An amount of a gold sensitizer is preferably $1\times10^{-4}$ to $1\times10^{-7}$ mol per mol of silver halide, and more preferably $1\times10^{-5}$ to $5\times10^{-7}$ mol. A preferable amount of a palladium compound is $1\times10^{-3}$ to $5\times10^{-7}$ mol per mol of silver halide. A preferable amount of a thiocyan compound or a selenocyan compound is $5\times10^{-2}$ to $1\times10^{-6}$ mol per mol of silver halide.

An amount of a sulfur sensitizer with respect to silver halide grains of the present invention is preferably $1\times10^{-4}$ to $1\times10^{-7}$ mol, and more preferably $1\times10^{-5}$ to $5\times10^{-7}$ mol per mol of a silver halide.

Selenium sensitization is a preferable sensitizing method for emulsions of the present invention. Known labile selenium compounds are used in the selenium sensitization. Practical examples of the selenium compound are colloidal metal selenium, selenoureas (e.g., N,N-dimethylselenourea and N,N-diethylselenourea), selenoketones, and selenoamides. In some cases, it is preferable to perform the selenium sensitization in combination with one or both of the sulfur sensitization and the noble metal sensitization.

Silver halide emulsions of the present invention are preferably subjected to reduction sensitization during grain formation, after grain formation and before or during chemical sensitization, or after chemical sensitization.

The reduction sensitization can be selected from a method of adding reduction sensitizers to a silver halide emulsion, a method called silver ripening in which grains are grown or ripened in a low-pAg ambient at pAg 1 to 7, and a method called high-pH ripening in which grains are grown or ripened in a high-pH ambient at pH 8 to 11. It is also possible to perform two or more of these methods together.

The method of adding reduction sensitizers is preferable in that the level of reduction sensitization can be finely adjusted.

Known examples of the reduction sensitizer are stannous chloride, ascorbic acid and its derivative, amines and polyamines, a hydrazine derivative, formamidinesulfinic acid, a silane compound, and a borane compound. In the reduction sensitization of the present invention, it is possible to selectively use these known reduction sensitizers or to use two or more types of compounds together. Preferable compounds as the reduction sensitizer are stannous chloride, thiourea dioxide, dimethylamineborane, and ascorbic acid and its derivative. An alkinylamine compound described in U.S. Pat. No. 5,389,510 also is an effective compound. Although an addition amount of the reduction sensitizers must be so selected as to meet the emulsion manufacturing conditions, a preferable amount is $10^{-7}$ to $10^{-3}$ mol per mol of a silver halide.

The reduction sensitizers are dissolved in water or a solvent, such as alcohols, glycols, ketones, esters, or amides, and the resultant solution is added during grain growth. Although adding to a reactor vessel in advance is also preferable, adding at a given timing during grain growth is more preferable. It is also possible to add the reduction sensitizers to an aqueous solution of a water-soluble silver salt or a water-soluble alkali halide to precipitate silver halide grains by using this aqueous solution. Alternatively, a solution of the reduction sensitizers can be added separately several times or continuously over a long time period with grain growth.

It is preferable to use an oxidizer for silver during the process of manufacturing emulsions of the present invention. The oxidizer for silver means a compound having an effect of converting metal silver into silver ion. A particularly effective compound is the one that converts very fine silver grains, as a by-product in the process of formation of silver halide grains and chemical sensitization, into silver ion. The silver ion produced can form a silver salt hard to dissolve in water, such as a silver halide, silver sulfide, or silver selenide, or a silver salt easy to dissolve in water, such as silver nitrate. The oxidizer for silver can be either an inorganic or organic substance. Examples of the inorganic oxidizer are ozone, hydrogen peroxide and its adduct (e.g., $NaBO_2 \cdot H_2O_2 \cdot 3H_2O$, $2NaCO_3 \cdot 3H_2O_2$, $Na_4P_2O_7 \cdot 2H_2O_2$, and $2Na_2SO_4 \cdot H_2O_2 \cdot 2H_2O$), peroxy acid salt (e.g., $K_2S_2O_8$, $K_2C_2O_6$, and $K_2P_2O_8$), a peroxy complex compound (e.g., $K_2[Ti(O_2)C_2O_4] \cdot 3H_2O$, $4K_2SO_4 \cdot Ti(O_2)OH \cdot SO_4 \cdot 2H_2O$, and $Na_3[VO(O_2)(C_2H_4)_2] \cdot 6H_2O$), permanganate (e.g., $KMnO_4$), an oxyacid salt such as chromate (e.g., $K_2Cr_2O_7$), a halogen element such as iodine and bromine, perhalogenate (e.g., potassium periodate), a salt of a high-valence metal (e.g., potassium hexacyanoferrate(II)), and thiosulfonate.

Examples of the organic oxidizer are quinones such as p-quinone, an organic peroxide such as peracetic acid and perbenzoic acid, and a compound for releasing active halogen (e.g., N-bromosuccinimide, chloramine T, and chloramine B).

Preferable oxidizers of the present invention are ozone, hydrogen peroxide and its adduct, a halogen element, an inorganic oxidizer of thiosulfonate, and an organic oxidizer of quinones. A disulfide compound described in European Patent No. 0627657A2 also is a preferable compound. A combination of the reduction sensitization described above and the oxidizer for silver is preferable. In this case, the reduction sensitization can be performed after the oxidizer is used or vice versa, or the reduction sensitization and the use of the oxidizer can be performed at the same time. These methods can be selectively performed during grain formation or chemical sensitization.

Photographic emulsions used in the present invention may contain various compounds in order to prevent fog during the manufacturing process, storage, or photographic treatments of a light-sensitive material, or to stabilize photographic properties. Usable compounds are those known as an antifoggant or a stabilizer, for example, thiazoles, such as benzothiazolium salt, nitroimidazoles, aitrobenzimidazoles, chlorobenzimidazoles, bromobenzimidazoles, mercaptothiazoles, mercaptobenzothiazoles, mecaptobenzimidazoles, mercaptothiadiazoles, aminotriazoles, benzotriazoles, nitrobenzotriazoles, and mercaptotetrazoles (particularly 1-phenyl-5-mercaptotetrazole); mercaptopyrimidines; mercaptotriazines; a thioketo compound such as oxadolinethione; azaindenes, such as triazaindenes, tetrazaindenes (particularly 4-hydroxy-substituted(1,3,3a,7) tetrazaindenes), and pentazaindenes. For example, compounds described in U.S. Pat. Nos. 3,954,474 and 3,982,947 and Jpn. Pat. Appln. KOKOKU Publication No. (hereinafter refereed to as JP-B-) 52-28660 can be used. One preferable compound is described in JP-A-63-212932. Antifoggants and stabilizers can be added at any of several different timings, such as before, during, and after grain formation, during washing with water, during dispersion after the washing, before, during, and after chemical sensitization, and before coating, in accordance with the intended application. The antifoggants and the stabilizers can be added during preparation of an emulsion to achieve their original fog preventing effect and stabilizing effect. In addition, the antifoggants and the stabilizers can be used for various purposes of, e.g., controlling crystal habit of grains, decreasing a grain size, decreasing the solubility of grains, controlling chemical sensitization, and controlling an arrangement of dyes.

Photographic emulsions used in the present invention are preferably subjected to spectral sensitization by methine dyes and the like in order to achieve the effects of the present invention. Usable dyes involve a cyanine dye, a merocyanine dye, a composite cyanine dye, a composite merocyanine dye, a holopolar cyanine dye, a hemicyanine dye, a styryl dye, and a hemioxonole dye. Most useful dyes are those belonging to a cyanine dye, a merocyanine dye, and a composite merocyanine dye. Any nucleus commonly used as a basic heterocyclic nucleus in cyanine dyes can be applied to these dyes. Examples of an applicable nucleus are a pyrroline nucleus, an oxazoline nucleus, a thiozoline nucleus, a pyrrole nucleus, an oxazole nucleus, a thiazole nucleus, a selenazole nucleus, an imidazole nucleus, a tetrazole nucleus, and a pyridine nucleus; a nucleus in which an aliphatic hydrocarbon ring is fused to any of the above nuclei; and a nucleus in which an aromatic hydrocarbon ring is fused to any of the above nuclei, e.g., an indolenine nucleus, a benzindolenine nucleus, an indole nucleus, a benzoxadole nucleus, a naphthoxazole nucleus, a benzthiazole nucleus, a naphthothiazole nucleus, a benzoselenazole nucleus, a benzimidazole nucleus, and a quinoline nucleus. These nuclei can be substituted on a carbon atom.

It is possible to apply to a merocyanine dye or a composite merocyanine dye a 5- to 6-membered heterocyclic nucleus as a nucleus having a ketomethylene structure. Examples are a pyrazoline-5-one nucleus, a thiohydantoin nucleus, a 2-thiooxazolidine-2,4-dione nucleus, a thiazolidine-2,4-dione nucleus, a rhodanine nucleus, and a thiobarbituric acid nucleus.

Although these sensitizing dyes may be used singly, they can also be used together. The combination of sensitizing dyes is often used for a supersensitization purpose. Representative examples of the combination are described in U.S. Pat. Nos. 2,688,545, 2,977,229, 3,397,060, 3,522,052, 3,527,641, 3,617,293, 3,628,964, 3,666,480, 3,672,898, 3,679,428, 3,703,377, 3,769,301, 3,814,609, 3,837,862, and 4,026,707, British Patents 1,344,281 and 1,507,803, JP-B-43-4936 and JP-B-53-12375, and JP-A-52-110618 and JP-A-52-109925.

Emulsions can contain, in addition to the sensitizing dyes, dyes having no spectral sensitizing effect or substances not essentially absorbing visible light and presenting supersensitization.

The sensitizing dyes can be added to an emulsion at any point in preparation of an emulsion, which is conventionally known to be useful. Most ordinarily, the addition is performed after completion of chemical sensitization and before coating. However, it is possible to perform the addition at the same timing as addition of chemical sensitizing dyes to perform spectral sensitization and chemical sensitization simultaneously, as described in U.S. Pat. Nos. 3,628,969 and 4,225,666. It is also possible to perform the addition prior to chemical sensitization, as described in JP-A-58-113928, or before completion of formation of a silver halide grain precipitation to start spectral sensitization. Alternatively, as disclosed in U.S. Pat. No. 4,225,666, these compounds can be added separately; a portion of the compounds may be added prior to chemical sensitization, while the remaining portion is added after that. That is, the compounds can be added at any timing during formation of silver halide grains, including the method disclosed in U.S. Pat. No. 4,183,756.

The addition amount can be $4\times10^{-6}$ to $8\times10^{-3}$ mol per mol of a silver halide. However, for a more preferable silver halide grain size of 0.2 to 1.2 μm, an addition amount of about $5\times10^{-5}$ to $2\times10^{-3}$ mol is more effective.

Although the several different additives described above can be used in the silver halide emulsions according to the present invention, a variety of other additives can also be used in accordance with the intended use.

The details of these additives are described in Research Disclosures Item 17643 (December, 1978), Item 18716 (November, 1979), and Item 308119 (December, 1989), and these portions are summarized in a table below.

| Additives | RD17643 | RD18716 |
|---|---|---|
| 1. Chemical sensitizers | page 23 | page 648, right column |
| 2. Sensitivity increasing agents | | ditto |
| 3. Spectral sensitizers, super sensitizers | pages 23–24 | page 648, right column to page 649, right column |
| 4. Brighteners | page 24 | |
| 5. Antifoggants and stabilizers | pages 24–25 | page 649, right column |
| 6. Light absorbent, filter dye, ultraviolet absorbents | pages 25–26 | page 649, right column to page 650, left column |
| 7. Stain preventing agents | page 25, right column | page 650, left to right columns |
| 8. Dye image stabilizer | page 25 | page 650, left column |
| 9. Hardening agents | page 26 | page 651, left column |
| 10. Binder | page 26 | ditto |
| 11. Plasticizers, lubricants | page 27 | page 650, right column |
| 12. Coating aids, surface active agents | pages 26–27 | ditto |
| 13. Antistatic agents | page 27 | ditto |
| 14. Matting agent | | |

| Additives | RD308119 |
|---|---|
| 1. Chemical sensitizers | page 996 |
| 2. Sensitivity increasing agents | |
| 3. Spectral sensitizers, super sensitizers | page 996, right column to page 998, right column |
| 4. Brighteners | page 998, right column |
| 5. Antifoggants and stabilizers | page 998, right column to page 1,000, right column |
| 6. Light absorbent, filter dye, ultraviolet absorbents | page 1,003, left column to page 1,003, right column |
| 7. Stain preventing agents | page 1,002, right column |
| 8. Dye image stabilizer | page 1,002, right column |
| 9. Hardening agents | page 1,004, right column to page 1,005, left column |
| 10. Binder | page 1,003, right column to page 1,004, right column |
| 11. Plasticizers, lubricants | page 1,006, left to right columns |
| 12. Coating aids, surface active agents | page 1,005, left column to page 1,006, left column |
| 13. Antistatic agents | page 1,006, right column to page 1,007, left column |
| 14. Matting agent | page 1,008, left column to page 1,009, left column |

Techniques such as a layer arrangement technique, silver halide emulsions, dye formation couplers, functional couplers such as DIR couplers, various additives, and development usable in the emulsions of the present invention and photographic light-sensitive materials using the emulsions are described in European Patent No. 0565096A1 (published in Oct. 13, 1993) and the patents cited in it. The individual items and the corresponding portions are enumerated below.

1. Layer arrangements: page 61, lines 23–35, page 61, line 41-page 62, line 41
2. Interlayers: page 61, lines 36–40
3. Interlayer effect imparting layers: page 62, lines 15–18
4. Silver halide halogen compositions: page 62, lines 21–25
5. Silver halide grain crystal habits: page 62, lines 26–30
6. Silver halide grain size: page 62, lines 31–34
7. Emulsion preparation methods: page 62, lines 35–40
8. Silver halide grain size distribution: page 62, lines 41–42
9. Tabular grains: page 62, lines 43–46
10. Internal structures of grains: page 62, lines 47–53
11. Latent image formation types of emulsions: page 62, line 52-page 63, line 5
12. Physical ripening-chemical ripening of emulsions: page 63, lines 6–9
13. Use of emulsion mixtures: page 63, lines 10–13
14. Fogged emulsions: page 63, lines 14–31
15. Non-light-sensitive emulsions: page 63, lines 32–43
16. Silver coating amount: page 63, lines 49–50
17. Photographic additives: described in Research Disclosure (RD) Item 17643 (December, 1978), RD Item 18716 (November, 1979), and RD Item 307105 (November, 1989). The individual items and the corresponding portions are presented below.

| Additives | RD17643 | RD18716 |
|---|---|---|
| 1. Chemical sensitizers | page 23 | page 648, right column |
| 2. Sensitivity increasing agents | | ditto |

-continued

| Additives | RD17643 | RD18716 |
|---|---|---|
| 3. Spectral sensitizers, super sensitizers | pages 23–24 | page 648, right column to page 649, right column |
| 4. Brighteners | page 24 | |
| 5. Antifoggants and stabilizers | pages 24–25 | page 649, right column |
| 6. Light absorbent, filter dye, ultraviolet absorbents | pages 25–26 | page 649, right column to page 650, left column |
| 7. Stain preventing agents | page 25, right column | page 650, left to right columns |
| 8. Dye image stabilizer | page 25 | page 650, left column |
| 9. Hardening agents | page 26 | page 651, left column |
| 10. Binder | page 26 | ditto |
| 11. Plasticizers, lubricants | page 27 | page 650, right column |
| 12. Coating aids, surface active agents | pages 26–27 | ditto |
| 13. Antistatic agents | page 27 | ditto |
| 14. Matting agent | | |

| Additives | RD307105 |
|---|---|
| 1. Chemical sensitizers | page 866 |
| 2. Sensitivity increasing agents | |
| 3. Spectral sensitizers, super sensitizers | pages 866–868 |
| 4. Brighteners | page 868 |
| 5. Antifoggants and stabilizers | pages 868–870 |
| 6. Light absorbent, filter dye, ultraviolet absorbents | page 873 |
| 7. Stain preventing agents | page 872 |
| 8. Dye image stabilizer | page 872 |
| 9. Hardening agents | pages 874–875 |
| 10. Binder | pages 873–874 |
| 11. Plasticizers, lubricants | page 876 |
| 12. Coating aids, surface active agents | pages 875–876 |
| 13. Antistatic agents | pages 876–877 |
| 14. Matting agent | pages 878–879 |

18. Formaldehyde scavengers: page 64, lines 54–57
19. Mercapto-based antifoggants: page 65, lines 1–2
20. Agents releasing, e.g., fogging agent: page 65, lines 3–7
21. Dyes: page 65, lines 7–10
22. General color couplers: page 65; lines 11–13
23. Yellow, magenta, and cyan couplers: page 65, lines 14–25
24. Polymer couplers: page 65, lines 26–28
25. Diffusing dye forming couplers: page 65, lines 29–31
26. Colored couplers: page 65, lines 32–38
27. General functional couplers: page 65, lines 39–44
28. Bleaching accelerator release couplers: page 65, lines 45–48
29. Development accelerator release couplers: page 65, lines 49–53
30. Other DIR couplers: page 65, line 54 - page 66, line 4
31. Coupler diffusing methods: page 66, lines 5–28
32. Antiseptic mildewproofing agents: page 66, lines 29–33
33. Types of light-sensitive materials: page 66, lines 34–36
34. Light-sensitive layer film thickness and swell -continued

| Additives | RD17643 | RD18716 |
|---|---|---|

speed: page 66, line 40 - page 67, line 1
35. Back layers: page 67, lines 3–8
36. General development processing: page 67, lines 9–11
37. Developers and developing agents: page 67, lines 12–30
38. Developer additives: page 67, lines 31–44
39. Reversal processing: page 67, lines 45–56
40. Processing solution aperture ratio: page 67, line 57 - page 68, line 12
41. Development time: page 68, lines 13–15
42. Bleach-fix, bleaching, and fixing: page 68, line 16 - page 69, line 31
43. Automatic processor: page 69, lines 32–40
44. Washing, rinsing, and stabilization: page 69, line 41 - page 70, line 18
45. Replenishment and reuse of processing solutions: page 70, lines 19–23
46. Incorporation of developing agent into light-sensitive material: page 70, lines 24–33
47. Development temperature: page 70, lines 34–38
48. Application to film with lens: page 70, lines 39–41

It is also possible to preferably use a bleaching solution described in European Patent No. 602600 which contains 2-pyridinecarboxylic acid or 2,6-pyridinedicarboxylic acid, ferric salt such as ferric nitrate, and persulfate. When this bleaching solution is to be used, it is preferable to interpose a stop step and a washing step between the color development step and the bleaching step and use organic acid such as acetic acid, succinic acid, or maleic acid as the stop bath. Furthermore, for the purposes of pH adjustment and bleaching fog, the bleaching solution preferably contains 0.1 to 2 mols/l of organic acid such as acetic acid, succinic acid, maleic acid, glutaric acid, or adipic acid.

EXAMPLES

The present invention will be described in more detail below by way of its examples. However, the present invention is not limited to these examples.

Example 1

The dependence of the silver iodide content in the first shell as the characteristic feature of the quintuple structure silver halide emulsion of the present invention will be described below.

(Preparation of seed emulsion a)

1600 ml of an aqueous solution containing 4.5 g of KBr and 7.9 g of gelatin with an average molecular weight of 15,000 were held at 40° C. and stirred. An aqueous solution of $AgNO_3$ (8.9 g) and an aqueous solution of KBr (6.2 g) containing 6.3 wt % of KI were added by a double-jet method over 40 sec. 38 g of gelatin were added, and the temperature was raised to 58° C. After an aqueous solution of $AgNO_3$ (5.6 g) was added, 0.1 mol of ammonia was added and the resultant material was neutralized with acetic acid in 15 min, controlling the pH to 5.0. Aqueous solutions of $AgNO_3$ (219 g) and KBr were added by the double-jet method over 40 min while the flow rates were accelerated. During the addition, the silver potential was held at −10 mV with respect to the saturated calomel electrode. After the resultant material was desalted, 50 g of gelatin were added to the material, and the pH and the pAg of the material were adjusted to 5.8 and 8.8, respectively, at 40° C., thereby preparing a seed emulsion. This seed emulsion contained 1 mol of Ag and 80 g of gelatin per kg of the emulsion. The fabular grains in the emulsion had an average equivalent-circle diameter of 0.62 μm, an equivalent-circle diameter variation coefficient of 16%, an average thickness of 0.103 μm, and an average aspect ratio of 6.0.

(Formation of core)

1200 ml of an aqueous solution containing 134 g of the seed emulsion a, 1.9 g of KBr, and 38 g of gelatin were held at 78° C. and stirred. After thiourea dioxide and ethylthiosulfonic acid were added, aqueous solutions of $AgNO_3$ (43.9 g) and KBr were added by the double-jet method over 25 min while the flow rates were accelerated. During the addition, the silver potential was held at −40 mV with respect to the saturated calomel electrode.

(Formation of first shell)

After the core grains were formed, aqueous solutions of $AgNO_3$ (43.9 g) and KBr were added by the double-jet method over 20 min while the flow rates were accelerated. During the addition, the silver potential was held at −40 mV with respect to the saturated calomel electrode.

Emulsions B, C, D, E, F, and G were prepared by changing the silver iodide content in the first shell by using an aqueous KBr solution containing KI, instead of the aqueous KBr solution used in the first shell. The grain shape and size of the emulsions B to G were nearly identical with that of the emulsion A. In the emulsions B to G, grains with an aspect ratio of 5 or more occupied about 85% of the total projected area of each emulsion. The characteristic features of the individual emulsions are summarized in Table 1 below.

In Table 1, "Ratio (mol %)" denotes the ratio of silver amount in the core or each shell, based on the total silver amount in the grain. The same can be applied to the following description.

TABLE 1

| | | Silver iodide content (mol %) | | | | | |
|---|---|---|---|---|---|---|---|
| | | Ratio (mol %) | | | | | |
| Emulsion | | Core 29.4 | First shell 19.4 | Second shell 18.8 | Third shell 3.1 | Fourth shell 29.3 | Total silver iodide content (mol %) |
| A | Comparative example | 0.6 | 0 | 0 | 100 | 0 | 3.3 |
| B | Comparative example | 0.6 | 6.2 | 0 | 100 | 0 | 4.5 |
| C | Comparative example | 0.6 | 9.3 | 0 | 100 | 0 | 5.1 |
| D | Comparative example | 0.6 | 14.0 | 0 | 100 | 0 | 6.0 |
| E | Present invention | 0.6 | 21.0 | 0 | 100 | 0 | 7.4 |
| F | Present invention | 0.6 | 31.4 | 0 | 100 | 0 | 9.4 |
| G | Comparative example | 0.6 | 47.1 | 0 | 100 | 0 | 12.4 |

(Formation of second shell)

After the first shell was formed, aqueous solutions of $AgNO_3$ (42.6 g) and KBr were added by the double-jet method over 17 min at fixed flow rates. During the addition, the silver potential was held at +40 mV with respect to the saturated calomel electrode. Thereafter, the temperature was lowered to 45° C.

(Formation of third shell)

After the second shell was formed, aqueous solution of $AgNO_3$ (7.1 g) and KI (6.9 g) were added by the double-jet method over 5 min.

(Formation of fourth shell)

After the third shell was formed, aqueous solutions of $AgNO_3$ (66.4 g) and KBr were added by the double-jet method over 30 min at fixed flow rates. In the middle of the addition, potassium iridium hexachloride was added. During the addition, the silver potential was held at −40 mV with respect to the saturated calomel electrode. Regular washing was performed, gelatin was added, and the pH and the pAg were adjusted to 5.8 and 8.8, respectively, at 40° C., thereby preparing an emulsion A. The tabular grains in the emulsion A had an average equivalent-circle diameter of 1.27 μm, an equivalent-circle diameter variation coefficient of 18%, an average thickness of 0.21 μm, an average aspect ratio of 6.1, and an average equivalent-sphere diameter of 0.78 μm. Grains with an aspect ratio of 5 or more accounted for about 85% of the total projected area.

Although reductions of the aspect ratio were found in the emulsions B to G, compared to the aspect ratio of the emulsion A, grains with an aspect ratio of 5 or more occupied about 85% of the total projected area in each emulsion.

The emulsions A to G were heated to 56° C. and optimally, chemically sensitized by adding sensitizing dyes I, II, and III and a compound I presented below, potassium thiocyanate, chloroauric acid, sodium thiosulfate, and N,N-dimethylselenourea.

Sensitizing dye I

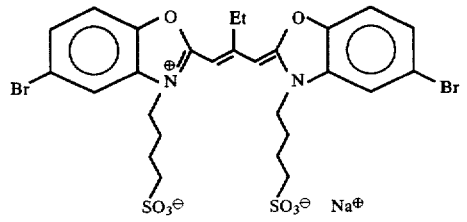

-continued

Sensitizing dye II

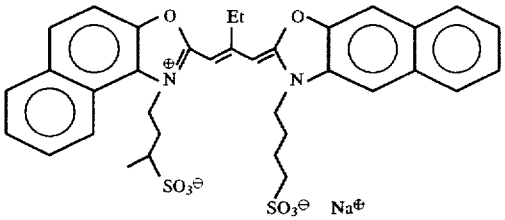

Sensitizing dye III

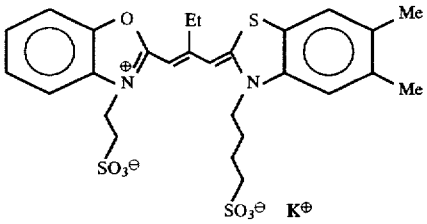

Compound I

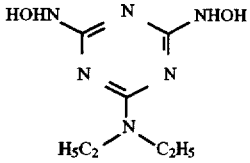

A cellulose triacetate film support having an undercoat layer was coated with the emulsion A subjected to the above chemical sensitization under the coating conditions shown in Table 2 below and a protective layer was formed. In this manner sample Nos. 1 to 7 were formed.

TABLE 2

| Emulsion coating conditions | |
|---|---|
| (1) Emulsion layer | |
| * Emulsion: Each emulsion | (Silver $2.1 \times 10^{-2}$ mol/m$^2$) |
| * Coupler | ($1.5 \times 10^{-3}$ mol/m$^2$) |

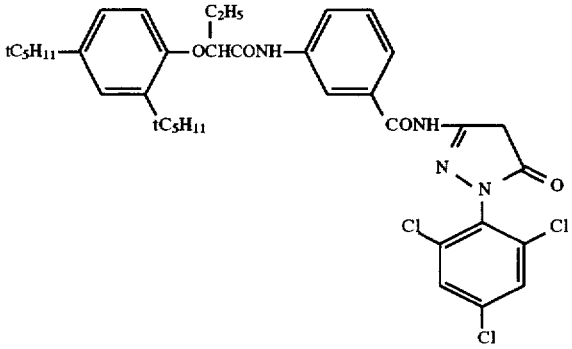

| | |
|---|---|
| * Tricresyl phosphate | (1.10 g/m$^2$) |
| * Gelatine | (2.30 g/m$^2$) |
| (2) Protective layer | |
| * 2,4-dichloro-6-hydroxy-s-triazine sodium salt | (0.08 g/m$^2$) |
| Gelatine | (1.80 g/m$^2$) |

These samples were left to stand at 40° C. and a relative humidity of 70% for 14 hours. The resultant samples were exposed for 1/100 sec through a gelatin filter SC-50 manufactured by Fuji Photo Film Co., Ltd. and with a continuous wedge.

By using a negative processor FP-350 manufactured by Fuji Photo Film Co., Ltd., the exposed samples were processed by the following method (until the accumulated replenisher amount of each solution was three times the mother solution tank volume).

(Processing Method)

| Step | Time | Temperature | Replenishment rate* |
|---|---|---|---|
| Color development | 3 min. 15 sec. | 38° C. | 45 ml |
| Bleaching | 1 min. 00 sec. | 38° C. | 20 ml bleaching solution overflow was entirely flowed into bleach-fix tank |
| Bleach-fix | 3 min. 15 sec. | 38° C. | 30 ml |
| Washing (1) | 40 sec. | 35° C. | counter flow piping from (2) to (1) |
| Washing (2) | 1 min. 00 sec. | 35° C. | 30 ml |
| Stabilization | 40 sec. | 38° C. | 20 ml |
| Drying | 1 min. 15 sec. | 55° C. | |

*The replenishment rate is represented by a value per 1.1 m of a 35-mm wide sample (equivalent to one 24 Ex. film).

The compositions of the processing solutions are presented below.

| (Color developer) | Tank solution (g) | Replenisher (g) |
|---|---|---|
| Diethylenetriamine pentaacetic acid | 1.0 | 1.1 |
| 1-hydroxyethylidene-1,1-diphosphonic acid | 2.0 | 2.0 |
| Sodium sulfite | 4.0 | 4.4 |
| Potassium carbonate | 30.0 | 37.0 |
| Potassium bromide | 1.4 | 0.7 |
| Potassium iodide | 1.5 mg | — |
| Hydroxylaminesulfate | 2.4 | 2.8 |
| 4-[N-ethyl-N-(β-hydroxy ethyl)amino]-2-methyl aniline sulfate | 4.5 | 5.5 |
| Water to make | 1.0 l | 1.0 l |
| pH (controlled by potassium hydroxide or sulfuric acid) | 10.05 | 10.10 |

| (Bleaching solution) | common to tank solution and replenisher (g) |
|---|---|
| Ferric ammonium ethylenediamine tetraacetate dihydrate | 120.0 |
| Disodium ethylenediamine tetraacetate | 10.0 |
| Ammonium bromide | 100.0 |
| Ammonium nitrate | 10.0 |
| Bleaching accelerator $(CH_3)_2N-CH_2-CH_2-S-S-CH_2-CH_2-N(CH_3)_2 \cdot 2HCl$ | 0.005 mol |
| Ammonia water (27%) | 15.0 ml |
| Water to make | 1.0 l |

-continued

| (Color developer) | Tank solution (g) | Replenisher (g) |
|---|---|---|
| pH (controlled by ammonia water and nitric acid) | | 6.3 |

| (Bleach-fix Solution) | Tank solution (g) | Replenisher (g) |
|---|---|---|
| Ferric ammonium ethylene diaminetetraacetate dihydrate | 50.0 | — |
| Disodium ethylenediamine tetraacetate | 5.0 | 2.0 |
| Ammonium sulfite | 12.0 | 20.0 |
| Aqueous ammonium thiosulfate solution (700 g/l) | 240.0 ml | 400.0 ml |
| Ammonia water (27%) | 6.0 ml | — |
| Water to make | 1.0 l | 1.0 l |
| pH (controlled by ammonia water or acetic acid) | 7.2 | 7.3 |
| (Washing water) | common to tank solution and replenisher | |

Tap water was supplied to a mixed-bed column filled with an H type strongly acidic cation exchange resin (Amberlite IR-120B: available from Rohm & Haas Co.) and an OH type strongly basic anion exchange resin (Amberlite IR-400: available from Rohm & Haas Co.) to set the ion concentrations of calcium and magnesium to be 3 mg/l or less. Subsequently, 20 mg/l of sodium isocyanuric acid dichloride and 0.15 g/l of sodium sulfate were added. The pH of the solution ranged from 6.5 to 7.5.

| (Stabilizer) | common to tank solution and replenisher (g) |
|---|---|
| Sodium p-toluenesulfinate | 0.03 |
| Polyoxyethylene-p-monononyl phenylether (average polymerization degree 10) | 0.2 |
| Disodium ethylenediaminetetraacetate | 0.05 |
| 1,2,4-triazole | 1.3 |
| 1,4-bis(1,2,4-triazole-1-ylmethyl) piperazine | 0.75 |
| Water to make | 1.0 l |
| pH | 8.5 |

The density of each processed sample was measured through a green filter.

The emulsions A to G had different developing speeds because their total silver iodide contents were different. Therefore, the color development times of the sample Nos. 1 to 7 were so changed that nearly equal maximum densities were obtained by these samples.

The values of sensitivity and fog of each sample obtained at a density of fog +0.2 are shown in Table 3 below. Assume that the sensitivity value of the sample No. 1 was 100. Note that the sample Nos. 1 to 7 had nearly equal granularities.

TABLE 3

Comparison in sensitivity and fog

| Sample No. | Emulsion | | Fog | Sensitivity |
|---|---|---|---|---|
| 1 | A | Comparative example | 0.24 | 100 |
| 2 | B | Comparative example | 0.23 | 105 |
| 3 | C | Comparative example | 0.23 | 105 |
| 4 | D | Comparative example | 0.23 | 107 |
| 5 | E | Present invention | 0.23 | 120 |
| 6 | F | Present invention | 0.22 | 123 |
| 7 | G | Comparative example | 0.22 | 91 |

As can be seen from Table 3, high sensitivity values were obtained without increasing the fog values by the use of the quintuple structure tabular grains of the present invention in which the silver iodide content in the first shell was 15 to 40 mol %. That is, the sensitivity/fog ratio and the sensitivity/granularity ratio were greatly improved. The effect of the present invention was not obtained by the sample Nos. 4 and 7 in which the silver iodide contents of the first shell were 14 mol % and 47.1 mol %, respectively, both of which were out of the range of the present invention. Also, the effect of the present invention was not obtained by the sample No. 1 corresponding to the triple structure grain described in U.S. Pat. No. 4,614,711 explained in "Background of the Invention". This indicates that the effect of the present invention is achieved by forming the first shell that corresponds to a high silver iodide content layer inside the third shell that corresponds to another high silver iodide content layer.

Example 2

The effect of forming the two internal high silver iodide content layers apart from each other, which is the characteristic feature of the quintuple structure grain of the present invention, will be described below.

Emulsions H, I, J, K, L, and M were prepared by changing the silver iodide contents in the first and second shells by using an aqueous KBr solution containing KI, instead of the aqueous KBr solution used in Example 1. The characteristic features of the individual emulsions are shown in Table 4 below.

In the emulsions H to M, grains with an aspect ratio of 5 or more occupied about 85% of the total projected area of each emulsion.

TABLE 4

| Emulsion | | Silver iodide content (mol %) Ratio (mol %) Core 29.4 | First shell 19.4 | Second shell 18.8 | Third shell 3.1 | Fourth shell 29.3 | Total silver iodide content (mol %) |
|---|---|---|---|---|---|---|---|
| H | Present invention | 0.6 | 28.0 | 0 | 100 | 0 | 8.7 |
| I | Present invention | 0.6 | 28.0 | 4.0 | 100 | 0 | 9.5 |
| J | Comparative example | 0.6 | 28.0 | 8.0 | 100 | 0 | 10.2 |
| K | Comparative example | 0.6 | 28.0 | 16.0 | 100 | 0 | 11.7 |
| L | Comparative example | 0.6 | 0 | 8.0 | 100 | 0 | 4.8 |
| M | Comparative example | 0.6 | 0 | 16.0 | 100 | 0 | 6.3 |

Sample Nos. 101 to 106 were formed by chemically sensitizing and coating these emulsions following the same procedures as in Example 1. Table 5 below shows the results of evaluation performed in the same manner as in Example 1. Assume that the sensitivity value of the sample No. 1 in Example 1 was 100. Noted that the sample Nos. 101 to 106 had nearly equal granularities.

TABLE 5

Comparison in sensitivity and fog

| Sample No. | Emulsion | | Fog | Sensitivity |
|---|---|---|---|---|
| 101 | H | Present invention | 0.22 | 126 |
| 102 | I | Present invention | 0.22 | 115 |
| 103 | J | Comparative example | 0.27 | 89 |
| 104 | K | Comparative example | 0.22 | 76 |
| 105 | L | Comparative example | 0.22 | 78 |
| 106 | M | Comparative example | 0.22 | 69 |

It is evident from Table 5 that high sensitivity values were obtained without increasing the fog values by the use of the quintuple structure tabular grains of the present invention in which the silver iodide content in the second shell was 0 to 5 mol %. That is, the sensitivity/fog ratio and the sensitivity/granularity ratio were greatly improved. The effect of the present invention was not obtained by the sample Nos. 103 and 104 in which the silver iodide contents in the second shell were 8 mol % and 16 mol %, respectively, both of which were out of the range of the present invention. Likewise, the effect of the present invention was not obtained by the sample Nos. 105 and 106 in which the second shell, instead of the first shell, was formed as a high silver iodide content layer. This demonstrates that it is necessary to form the second shell as a low silver iodide content layer between the third shell as a high silver iodide content layer and the first shell as another high silver iodide content layer inside the third shell.

Example 3

The effect of the core and the fourth shell having low silver iodide contents as the characteristic feature of the quintuple structure grain of the present invention will be described below.

Emulsions N, O, P, and Q were prepared by changing the silver iodide contents in the core and the first and fourth shells by using an aqueous KBr solution containing KI, instead of the aqueous KBr solution used in Example 1. Additionally, an emulsion R was prepared by using an aqueous KBr solution in the third shell in place of the aqueous KI solution. Also, an emulsion S was prepared to obtain the fourth shell being splitted into two parts different in the silver iodide content. The characteristic features of the individual emulsions are shown in Table 6 below.

In the emulsions N to S, grains with an aspect ratio of 5 or more occupied about 85% of the total projected area of each emulsion.

TABLE 6

| Emulsion | | Silver iodide content (mol %) Ratio (mol %) Core 29.4 | First shell 19.4 | Second shell 18.8 | Third shell 3.1 | Fourth shell 29.3 | Total silver iodide content (mol %) |
|---|---|---|---|---|---|---|---|
| H | Present invention | 0.6 | 28.0 | 0 | 100 | 0 | 8.7 |
| O | Present invention | 0.6 | 28.0 | 0 | 100 | 4.0 | 9.9 |

TABLE 6-continued

| Emulsion | | Silver iodide content (mol %) Core 29.4 | First shell 19.4 | Second shell 18.8 | Third shell 3.1 | Fourth shell 29.3 | Total silver iodide content (mol %) |
|---|---|---|---|---|---|---|---|
| | | Ratio (mol %) | | | | | |
| P | Comparative example | 0.6 | 28.0 | 0 | 100 | 8.0 | 11.1 |
| Q | Comparative example | 0.6 | 28.0 | 0 | 100 | 16.0 | 13.4 |
| R | Comparative example | 28.0 | 28.0 | 0 | 0 | 0 | 13.7 |
| S | Comparative example | 0.6 | 0 | 0 | 100 | 16.0/0 | 5.6 |

Sample Nos. 201 to 206 were formed by chemically sensitizing and coating these emulsions following the same procedures as in Example 1. Table 7 below shows the results of evaluation performed in the same manner as in Example 1. Assume that the sensitivity value of the sample No. 1 in Example 1 was 100. Note that the sample Nos. 201 to 206 had nearly equal granularities.

TABLE 7

Comparison in sensitivity and fog

| Sample No. | Emulsion | | Fog | Sensitivity |
|---|---|---|---|---|
| 201 | N | Present invention | 0.22 | 126 |
| 202 | O | Present invention | 0.22 | 117 |
| 203 | P | Comparative example | 0.22 | 74 |
| 204 | Q | Comparative example | 0.18 | 59 |
| 205 | R | Comparative example | 0.22 | 54 |
| 206 | S | Comparative example | 0.22 | 93 |

It is evident from Table 7 that high sensitivity values were obtained without increasing the fog values by the use of the quintuple structure tabular grains of the present invention in which the silver iodide content in the fourth shell was 0 to 5 mol %. That is, the sensitivity/fog ratio and the sensitivity/granularity ratio were greatly improved. The effect of the present invention was not obtained by the sample Nos. 203 and 204 in which the silver iodide contents in the fourth shell were 8 mol % and 16 mol %, respectively, both of which were out of the range of the present invention. Likewise, the effect of the present invention was not obtained by the sample No. 205 in which the third shell had a low silver iodide content out of the range of the present invention. The sample No. 205 is equivalent to the double structure grain described in U.S. Pat. No. 4,668,614 explained in "Background of the Invention". Also, the effect of the present invention was not obtained by the sample No. 206 in which the fourth shell was split into two parts to form the quadruple structure grain described in European Patent No. 202784B. That is, the effect of the quintuple structure grain of the present invention is obtained when the silver iodide contents in the core, the first shell, the second shell, the third shell, and the fourth shell are within the range of the present invention.

Example 4

The ratios of the silver amount in the core, the first shell, the second shell, the third shell, and the fourth shell to the total silver amount in the quintuple structure grain of the present invention will be described below.

Emulsions T, U, V, W, X, and Y were prepared by changing the silver amount ratios of the core, the first shell, the second shell, the third shell, and the fourth shell in Example 1. The characteristic features of the individual emulsion are presented in Table 8 below.

In the emulsions T to Y, grains with an aspect ratio of 5 or more occupied about 85% of the total projected area in each emulsion.

TABLE 8

| Emulsion | | Silver amount ratio (mol %) Silver iodide content (mol %) Core 0.6 | First shell 28.0 | Second shell 0 | Third shell 100 | Fourth shell 0 |
|---|---|---|---|---|---|---|
| T | Present invention | 29.4 | 19.4 | 18.8 | 3.1 | 29.3 |
| U | Comparative example | 29.4 | 33.0 | 5.2 | 3.1 | 29.3 |
| V | Comparative example | 29.4 | 3.2 | 35.0 | 3.1 | 29.3 |
| W | Comparative example | 29.4 | 19.4 | 18.8 | 12.0 | 20.4 |
| X | Comparative example | 52.5 | 19.4 | 18.8 | 3.1 | 6.2 |
| Y | Comparative example | 15.0 | 19.4 | 18.8 | 3.1 | 43.7 |

Sample Nos. 301 to 306 were formed by chemically sensitizing and coating these emulsions following the same procedures as in Example 1. Table 9 below shows the results of evaluation performed in the same manner as in Example 1. Assume that the sensitivity value of the sample No. 1 in Example 1 was 100. Note that the sample Nos. 301 to 306 had nearly equal granularities.

TABLE 9

| Comparison in sensitivity and fog | | | | |
|---|---|---|---|---|
| Sample No. | Emulsion | | Fog | Sensitivity |
| 301 | T | Present invention | 0.22 | 126 |
| 302 | U | Comparative example | 0.22 | 105 |
| 303 | V | Comparative example | 0.22 | 105 |
| 304 | W | Comparative example | 0.31 | 19 |
| 305 | X | Comparative example | 0.29 | 19 |
| 306 | Y | Comparative example | 0.21 | 91 |

As can be seen from Table 9, high sensitivity values were obtained without increasing the fog values by the silver amount ratios of the core and the individual shells of the quintuple structure tabular grains of the present invention. That is, the sensitivity/fog ratio and the sensitivity/granularity ratio were greatly improved. The effect of the present invention was not obtained by the sample No. 302 in which the ratios of the silver amount in the first and second shells were 33% and 5.2%, respectively, both of which were out of the range of the present invention. The effect of the present invention was not obtained by the sample No. 303 in which the ratios of the first and second shells were 3.2% and 35.0%, respectively, both of which were out of the range of the present invention. The effect of the present invention was not obtained by the sample No. 304 in which the ratio of the third shell was 12.0% which was out of the range of the present invention. The effect of the present invention was not obtained by the sample No. 305 in which the ratios of the core and the fourth shell were 52.5% and 6.2%, respectively, both of which were out of the range of the present invention. The effect of the present invention was not obtained by the sample No. 306 in which the ratios of the core and the fourth shell were 15.0% and 43.7%, respectively, both of which were out of the range of the present invention. That is, the effect of the quintuple structure grain of the present invention is obtained when the silver amount ratios of the core, the first shell, the second shell, the third shell, and the fourth shell are within the range of the present invention.

Example 5

Other characteristic features of the quintuple structure silver halide emulsion of the present invention will be described below.

(Preparation of seed emulsion b)

1500 ml of an aqueous solution containing 0.75 g of gelatin were held at 35° C. and stirred. The silver potential was adjusted to −10 mV with respect to the saturated calomel electrode, and the pH was adjusted to 1.90. An aqueous solution of $AgNO_3$ (0.85 g) and an aqueous solution of KBr (0.59 g) were added by a double-jet method over 15 sec. After the temperature was raised to 60° C., 8.3 g of gelatin were added. The pH was adjusted to 5.5, and the silver potential was adjusted to −20 mV with respect to the saturated calomel electrode. Aqueous solutions of $AgNO_3$ (227.1 g) and KBr were added by the double-jet method over 45 min while the flow rates were accelerated. During the addition, the silver potential was held at −20 mV with respect to the saturated calomel electrode. After the resultant material was desalted, 50 g of gelatin were added to the material, and the pH and the pAg of the material were adjusted to 5.8 and 8.8, respectively, at 40° C., thereby preparing a seed emulsion. This seed emulsion contained 1 mol of Ag and 80 g of gelatin per kg of the emulsion. The emulsion consisted of tabular grains with an average equivalent-circle diameter of 0.71 μm, an equivalent-circle diameter variation coefficient of 17%, an average thickness of 0.081 μm, and an average aspect ratio of 8.8.

(Formation of core)

1200 ml of an aqueous solution containing 134 g of the seed emulsion b, 1.9 g of KBr, and 38 g of gelatin were held at 65° C. and stirred. After thiourea dioxide was added, aqueous solutions of $AgNO_3$ (43.9 g) and KBr were added by the double-jet method over 23 min while the flow rates were accelerated. During the addition, the silver potential was held at −20 mV with respect to the saturated calomel electrode.

(Formation of first shell)

After the core grains were formed, an aqueous solution of $AgNO_3$ (43.9 g) and an aqueous KBr solution containing KI were added by the double-jet method over 19 min while the flow rates were accelerated. During the addition, the silver potential was held at −20 mV with respect to the saturated calomel electrode.

(Formation of second shell)

After the first shell was formed, an aqueous solution of $AgNO_3$ (42.6 g) and an aqueous KBr solution containing KI were added by the double-jet method over 8 min while the flow rates were accelerated. During the addition, the silver potential was held at +20 mV with respect to the saturated calomel electrode.

(Formation of third shell)

After the second shell was formed, benzenethiosulfonic acid was added and an aqueous KBr solution was added to adjust the silver potential to −80 mV. 8.5 g, in terms of an amount of $AgNO_3$, of a silver iodide fine grain emulsion having an average equivalent-circle diameter of 0.025 μm and an equivalent-circle diameter variation coefficient of 18% were abruptly added within 5 sec.

(Formation of fourth shell)

When 30 seconds elapsed after the silver iodide fine grain emulsion was added, an aqueous solution of $AgNO_3$ (66.4 g) was added by the double-jet method over 4 min while the flow rate was decelerated. In the middle of the addition, potassium iridium hexachloride was added. After the addition, the silver potential was found to be −10 mV. Regular washing was performed, gelatin was added, and the pH and the pAg were adjusted to 5.8 and 8.8, respectively, at 40° C., thereby preparing an emulsion Z-1. The tabular grains in emulsion Z-1 had an average equivalent-circle diameter of 1.40 μm, an equivalent-circle diameter variation coefficient of 19%, an average thickness of 0.159 μm, an average aspect ratio of 8.8, and an average equivalent-sphere diameter of 0.78 μm. Grains with an aspect ratio of 8 or more accounted for about 90% of the total projected area. An emulsion Z-2 was prepared by changing the silver iodide contents in the first and second shells. The grain shape was nearly identical with that of the emulsion z-1. The characteristic features of the emulsions z-1 and z-2 are shown in Table 10 below.

TABLE 10

| Emulsion | | Silver iodide content (mol %) Core 29.2 | Ratio (mol %) First shell 19.2 | Second shell 18.7 | Third shell 3.7 | Fourth shell 29.1 | Total silver iodide content (mol %) |
|---|---|---|---|---|---|---|---|
| Z-1 | Comparative example | 0 | 14.5 | 14.0 | 100 | 0 | 9.1 |
| Z-2 | Present invention | 0 | 28.0 | 0 | 100 | 0 | 9.1 |

Sample Nos. 401 and 402 were formed by chemically sensitizing and coating these emulsions following the same procedures as in Example 1 and evaluated in the same manner as in Example 1.

Furthermore, to evaluate the characteristics to pressure, the emulsion coated surface of each sample was scratched with a thin needle 50 μm in diameter applied with a load of 4 g, and the resultant sample was exposed and processed following the same procedures as in Example 1. Thereafter, an increase in the fog density and a decrease in the image density caused by the scratch with thin needle were evaluated. Also, the reciprocity characteristics were evaluated by changing the exposure time to 10 sec. The results are summarized in Table 11 below. The values of sensitivity and fog of each sample were obtained in the same manner as in Example 1, except that assuming the sensitivity value of the sample No. 401 with 1/100 sec. exposure was 100. Note that the sample Nos. 401 and 402 had nearly equal granularities.

TABLE 11

| Sample No. | Emulsion | | Fog | Sensitivity 1/100-sec exposure | 10-sec exposure | Increase in fog | Scratch with thin needle: Decrease in density at the portion of density of 1.5 |
|---|---|---|---|---|---|---|---|
| 401 | Z-1 | Comparative example | 0.18 | 100 | 72 | 0.23 | 0.03 |
| 402 | Z-2 | Present invention | 0.18 | 132 | 120 | 0.20 | 0 |

As ia apparent from Table 11, the quintuple structure grain of the present invention was greatly improved in the sensitivity/fog ratio and the sensitivity/granularity ratio. Additionally, the degree of decrement in sensitivity of the sample No. 402 from that obtained with 100-sec exposure to that obtained with 10-sec exposure is suppressed compared with the degree of decrement of the sample No. 401, indicating excellent reciprocity characteristics. Also, both the increase in fog and the decrease in density caused by the scratch with thin needle were small. This indicates good characteristics to pressure.

Example 6

The emulsion prepared in Example 5 was coated as the ninth layer of the light-sensitive material described below and evaluated. The result was that the remarkable effects of the present invention similar to those in Example 5 were obtained.

1) Support

A support used in this example was formed as follows.

100 parts by weight of a polyethylene-2,6-naphthalate polymer and 2 parts by weight of Tinuvin P.326 (manufactured by Ciba-Geigy Co.) as an ultraviolet absorbent were dried, melted at 300° C., and extruded from a T-die. The resultant material was longitudinally oriented by 3.3 times at 140° C., laterally oriented by 3.3 times at 130° C., and thermally fixed at 250° C. for 6 sec. The result was a 90-μm thick PEN, polyethylene naphthalate, film. Note that this PEN film was added with proper amounts of blue, magenta, and yellow dyes (I-1, I-4, I-6, I-24, I-26, I-27, and II-5 described in Journal of Technical Disclosure No. 94-6023). The PEN film was wound around a stainless steel core 20 cm in diameter and given a thermal history of 110° C. and 48 hours, manufacturing a support with a high resistance to curling.

2) Coating of undercoat layer

The two surfaces of the support were subjected to corona discharge, UV discharge, and glow discharge and coated with an undercoat solution (10 cc/m$^2$, by using a bar coater) consisting of 0.1 g/m$^2$ of gelatin, 0.01 g/m$^2$ of sodium α-sulfodi-2-ethylhexylsuccinate, 0.04 g/m$^2$ of salicylic acid, 0.2 g/m$^2$ of p-chlorophenol, 0.012 g/m$^2$ of $(CH_2{=}CHSO_2CH_2CH_2NHCO)_2CH_2$, and 0.02 g/m$^2$ of a polyamido-epichlorohydrin polycondensation product, forming undercoat layers on sides at a high temperature upon orientation. Drying was performed at 115° C. for 6 min (all rollers and conveyors in the drying zone were at 115° C.).

3) Coating of back layers

On one surface of the undercoated support, an antistatic layer, a magnetic recording layer, and a slip layer having the following compositions were coated as back layers.

3-1) Coating of antistatic layer 0.2 g/m$^2$ of a dispersion (secondary aggregation grain size=about 0.08 μm) of a fine-grain powder, having a specific resistance of 5 Ω·cm, of a tin oxide-antimony oxide composite material with an average grain size of 0.005 μm was coated together with 0.05 g/m$^2$ of gelatin, 0.02 g/m$^2$ of $(CH_2{=}CHSO_2CH_2CH_2NHCO)_2CH_2$, 0.005 g/m$^2$ of polyoxyethylene-p-nonylphenol (polymerization degree 10), and resorcin.

3-2) Coating of magnetic recording layer 0.06 g/m$^2$ of cobalt-γ-iron oxide (specific area 43 m$^2$/g, major axis 0.14 μm, minor axis 0.03 μm, saturation magnetization 89 emu/g, $Fe^{+2}/Fe^{+3}$=6/94, the surface was treated with 2 wt % of iron oxide by aluminum oxide silicon oxide) coated with 3-polyoxyethylene-propyloxytrimethoxysilane (polymerization degree 15, 15 wt %) was coated by a bar coater together with 1.2 g/m$^2$ of diacetylcellulose (iron oxide was dispersed by an open kneader and a sand mill) by using 0.3 g/m$^2$ of $C_2H_5C(CH_2OCONH\text{-}C_6H_3(CH_3)NCO)_3$ as a hardener and acetone, methylethylketone, and cyclohexane as solvents, forming a 1.2-μm thick magnetic recording layer. 10 mg/m$^2$ of silica grains (0.3 μm) were added as a matting agent, and 10 mg/m$^2$ of aluminum oxide (0.15 μm) coated with 3-polyoxyethylene-propyloxytrimethoxysilane (polymerization degree 15, 15 wt %) were added as a polishing agent. Drying was performed at 115° C. for 6 min (all rollers and conveyors in the drying zone were at 115° C.). The color density increase of $D^B$ of the magnetic recording layer measured by an X-light (blue filter) was about 0.1. The saturation magnetization moment, coercive force, and squareness ratio of the magnetic recording layer were 4.2 emu/g, 7.3×10$^4$ A/m, and 65%, respectively.

3-3) Preparation of slip layer

Diacetylcellulose (25 mg/m$^2$) and a mixture of $C_6H_{13}CH(OH)C_{10}H_{20}COOC_{40}OH_{81}$ (compound a, 6 mg/m$^2$)/$C_{50}H_{101}O(CH_2CH_2O)_{16}H$ (compound b, 9 mg/m$^2$) were coated. Note that this mixture was melted in xylene/propylenemonomethylether (1/1) at 105° C., dispersed in propylenemonomethylether (tenfold amount), and formed into a dispersion (average grain size 0.01 μm) in acetone before being added. 15 mg/m$^2$ of silica grains (0.3 μm) were added as a matting agent, and 15 mg/m$^2$ of aluminum oxide (0.15 μm) coated by 3-polyoxyethylene-propyloxytrimethoxysiliane (polymerization degree 15, 15 wt %) were added as a polishing agent. Drying was performed at 115° C. for 6 min (all rollers and conveyors in the drying zone were at 115° C.). The resultant slip layer was found to have excellent characteristics. That is, the coefficient of kinetic friction was 0.06 (5 mmΦ stainless steel hard sphere, load 100 g, speed 6 cm/min), and the coefficient of static friction was 0.07 (clip method). The coefficient of kinetic friction between an emulsion surface (to be described later) and the slip layer also was excellent, 0.12.

4) Coating of light-sensitive layers

On the side away from the back layers formed as above, a plurality of layers having the following compositions were coated to manufacture a color negative film.

(Compositions of light-sensitive layers)

The main materials used in the individual layers were classified as follows.

ExC: Cyan coupler UV: Ultraviolet absorbent

ExM: Magenta coupler HBS: High-boiling organic solvent

ExY: Yellow coupler H: Gelatin hardener

ExS: Sensitizing dye (In the following description, practical compounds are represented by these symbols followed by numbers, and their chemical formulas are presented later).

The number corresponding to each component indicates the coating amount in units of g/m$^2$. The coating amount of a silver halide is indicated in terms of the amount of silver. The coating amount of each sensitizing dye is represented in units of mols per mol of a silver halide in the same layer.

| | | |
|---|---|---|
| **1st layer (Antihalation layer)** | | |
| Black colloidal silver | silver | 0.09 |
| Gelatin | | 1.60 |
| ExM-1 | | 0.12 |
| ExF-1 | | 2.0 × 10$^{-3}$ |
| Solid dispersion dye ExF-2 | | 0.030 |
| Solid dispersion dye ExF-3 | | 0.040 |
| HBS-1 | | 0.15 |
| HBS-2 | | 0.02 |
| **2nd layer (Interlayer)** | | |
| Silver iodobromide emulsion m | silver | 0.065 |
| ExC-2 | | 0.04 |
| Polyethylacrylate latex | | 0.20 |
| Gelatin | | 1.04 |
| **3rd layer (Low-speed red-sensitive emulsion layer)** | | |
| Silver iodobromide emulsion a | silver | 0.25 |
| Silver iodobromide emulsion b | silver | 0.25 |
| ExS-1 | | 6.9 × 10$^{-5}$ |
| ExS-2 | | 1.8 × 10$^{-5}$ |
| ExS-3 | | 3.1 × 10$^{-4}$ |
| ExC-1 | | 0.17 |
| ExC-3 | | 0.030 |
| ExC-4 | | 0.10 |
| ExC-5 | | 0.020 |
| ExC-6 | | 0.010 |
| Cpd-2 | | 0.025 |
| HBS-1 | | 0.10 |
| Gelatin | | 0.87 |
| **4th layer (Medium-speed red-sensitive emulsion layer)** | | |
| Silver iodobromide emulsion c | silver | 0.70 |
| ExS-1 | | 3.5 × 10$^{-4}$ |
| ExS-2 | | 1.6 × 10$^{-5}$ |
| ExS-3 | | 5.1 × 10$^{-4}$ |
| ExC-1 | | 0.13 |
| ExC-2 | | 0.060 |
| ExC-3 | | 0.0070 |
| ExC-4 | | 0.090 |
| ExC-5 | | 0.015 |
| ExC-6 | | 0.0070 |
| Cpd-2 | | 0.023 |
| HBS-1 | | 0.10 |
| Gelatin | | 0.75 |
| **5th layer (High-speed red-sensitive emulsion layer)** | | |
| Silver iodobromide emulsion d | silver | 1.40 |
| ExS-1 | | 2.4 × 10$^{-4}$ |
| ExS-2 | | 1.0 × 10$^{-4}$ |
| ExS-3 | | 3.4 × 10$^{-4}$ |
| ExC-1 | | 0.10 |
| ExC-3 | | 0.045 |
| ExC-6 | | 0.020 |
| ExC-7 | | 0.010 |
| Cpd-2 | | 0.050 |
| HBS-1 | | 0.22 |
| HBS-2 | | 0.050 |
| Gelatin | | 1.10 |
| **6th layer (Interlayer)** | | |
| Cpd-1 | | 0.090 |
| Solid dispersion dye ExF-4 | | 0.030 |
| HBS-1 | | 0.050 |
| Polyethylacrylate latex | | 0.15 |
| Gelatin | | 1.10 |
| **7th layer (Low-speed green-sensitive emulsion layer)** | | |
| Silver iodobromide emulsion e | silver | 0.15 |
| Silver iodobromide emulsion f | silver | 0.10 |
| Silver iodobromide emulsion g | silver | 0.10 |
| ExS-4 | | 3.0 × 10$^{-5}$ |

-continued

| | | |
|---|---|---|
| ExS-5 | | $2.1 \times 10^{-4}$ |
| ExS-6 | | $8.0 \times 10^{-4}$ |
| ExM-2 | | 0.33 |
| ExM-3 | | 0.086 |
| ExY-1 | | 0.015 |
| HBS-1 | | 0.30 |
| HBS-3 | | 0.010 |
| Gelatin | | 0.73 |
| 8th layer (Medium-speed green-sensitive emulsion layer) | | |
| Silver iodobromide emulsion h | silver | 0.80 |
| ExS-4 | | $3.2 \times 10^{-5}$ |
| ExS-5 | | $2.2 \times 10^{-4}$ |
| ExS-6 | | $8.4 \times 10^{-4}$ |
| ExC-8 | | 0.010 |
| ExM-2 | | 0.10 |
| ExM-3 | | 0.025 |
| ExY-1 | | 0.018 |
| ExY-4 | | 0.010 |
| ExY-5 | | 0.040 |
| HBS-1 | | 0.13 |
| HBS-3 | | $4.0 \times 10^{-3}$ |
| Gelatin | | 0.80 |
| 9th layer (High-speed green-sensitive emulsion layer) | | |
| Silver iodobromide emulsion i | silver | 1.25 |
| ExS-4 | | $3.7 \times 10^{-5}$ |
| ExS-5 | | $8.1 \times 10^{-5}$ |
| ExS-6 | | $3.2 \times 10^{-4}$ |
| ExC-1 | | 0.010 |
| ExM-1 | | 0.020 |
| ExM-4 | | 0.025 |
| ExM-5 | | 0.040 |
| Cpd-3 | | 0.040 |
| HBS-1 | | 0.25 |
| Polyethylacrylate latex | | 0.15 |
| Gelatin | | 1.33 |
| 10th layer (Yellow filter layer) | | |
| Yellow colloidal silver | silver | 0.015 |
| Cpd-1 | | 0.16 |
| Solid dispersion dye ExF-5 | | 0.060 |
| Solid dispersion dye ExF-6 | | 0.060 |
| Oil-soluble dye ExF-7 | | 0.010 |
| HBS-1 | | 0.60 |
| Gelatin | | 0.60 |
| 11th layer (Low-speed blue-sensitive emulsion layer) | | |
| Silver iodobromide emulsion j | silver | 0.09 |
| Silver iodobromide emulsion k | silver | 0.09 |
| ExS-7 | | $8.6 \times 10^{-4}$ |
| ExC-8 | | $7.0 \times 10^{-3}$ |
| ExY-1 | | 0.050 |
| ExY-2 | | 0.22 |
| ExY-3 | | 0.50 |
| ExY-4 | | 0.020 |
| Cpd-2 | | 0.10 |
| Cpd-3 | | $4.0 \times 10^{-3}$ |
| HBS-1 | | 0.28 |
| Gelatin | | 1.20 |
| 12th layer (High-speed blue-sensitive emulsion layer) | | |
| Silver iodobromide emulsion l | silver | 1.00 |
| ExS-7 | | $4.0 \times 10^{-4}$ |

-continued

| | | |
|---|---|---|
| ExY-2 | | 0.10 |
| ExY-3 | | 0.10 |
| ExY-4 | | 0.010 |
| Cpd-2 | | 0.10 |
| Cpd-3 | | $1.0 \times 10^{-3}$ |
| HBS-1 | | 0.070 |
| Gelatin | | 0.70 |
| 13th layer (1st protective layer) | | |
| UV-1 | | 0.19 |
| UV-2 | | 0.075 |
| UV-3 | | 0.065 |
| HBS-1 | | $5.0 \times 10^{-2}$ |
| HBS-4 | | $5.0 \times 10^{-2}$ |
| Gelatin | | 1.8 |
| 14th (2nd protective layer) | | |
| Silver iodobromide emulsion m | silver | 0.10 |
| H-1 | | 0.40 |
| B-1 (diameter 1.7 μm) | | $5.0 \times 10^{-2}$ |
| B-2 (diameter 1.7 μm) | | 0.15 |
| B-3 | | 0.05 |
| S-1 | | 0.20 |
| Gelatin | | 0.70 |

In addition to the above components, to improve storage stability, processability, a resistance to pressure, antiseptic and mildewproofing properties, antistatic properties, and coating properties, the individual layers contained W-1 to W-3, B-4 to B-6, F-1 to F-17, iron salt, lead salt, gold salt, platinum salt, palladium salt, iridium salt, and rhodium salt.

Preparation of dispersion of organic solid dispersion dye.

ExF-2 in the first layer was dispersed by the following method. 21.7 ml of water, 3 ml of a 5% aqueous solution of p-octylphenoxyethoxyethanesulfonic acid soda, and 0.5 g of a 5% aqueous solution of p-octylphenoxypolyoxyethyleneether (polymerization degree 10) were placed in a 700-ml pot mill, and 5.0 g of dye ExF-2 and 500 ml of zirconium oxide beads (diameter 1 mm) were added to the mill. The contents were dispersed for 2 hours by using a BO type oscillating ball mill manufactured by Chuo Koki K. K. The dispersion was removed from the mill and added to 8 g of a 12.5% aqueous gelatin solution. The beads were removed from the resultant material by filtration, obtaining a gelatin dispersion of the dye. The average grain size of the fine dye grains was 0.44 μm.

Following the same procedure as above, solid dispersions ExF-3, ExF-4, and ExF-6 were obtained. The average grain sizes of these fine dye grains were 0.24, 0.45, and 0.52 μm, respectively. ExF-5 was dispersed by a microprecipitation dispersion method described in Example 1 of European Patent No. 549,489A. The average grain size was found to be 0.06 μm.

The compounds used in the formation of the above layers are as follows.

ExC-1

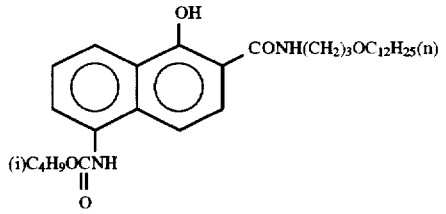

-continued
ExC-2
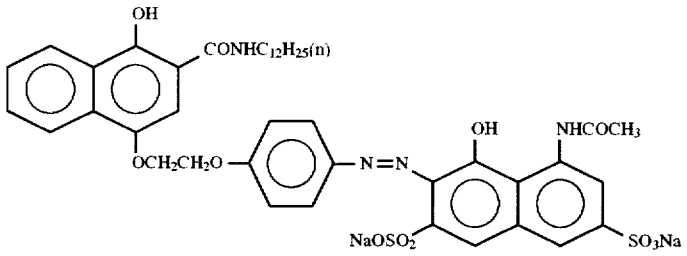
ExC-3
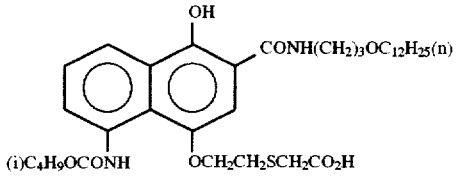
ExC-4
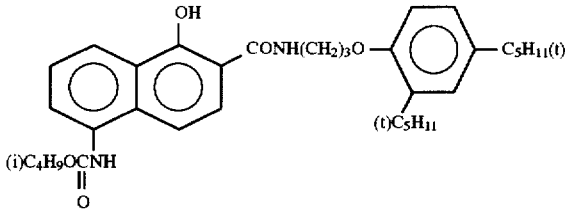
ExC-5
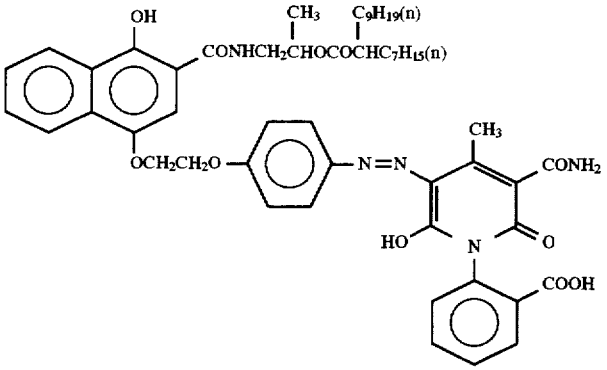
ExC-6
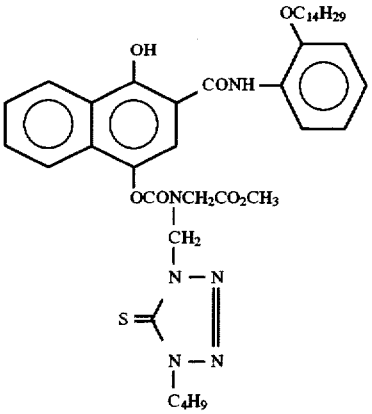
ExC-7
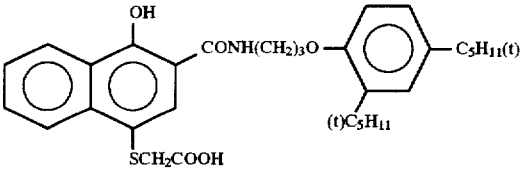

-continued
ExC-8
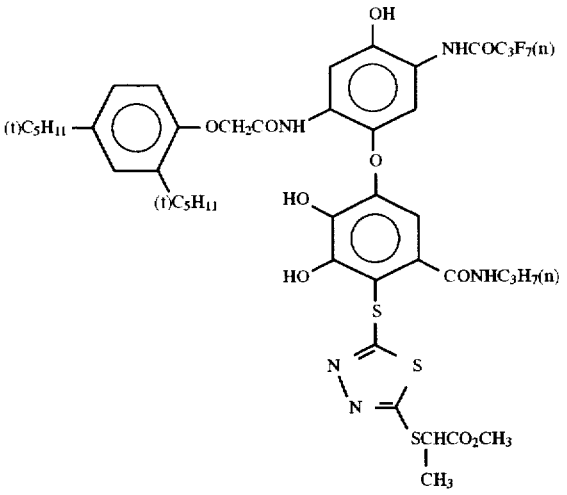
ExM-1
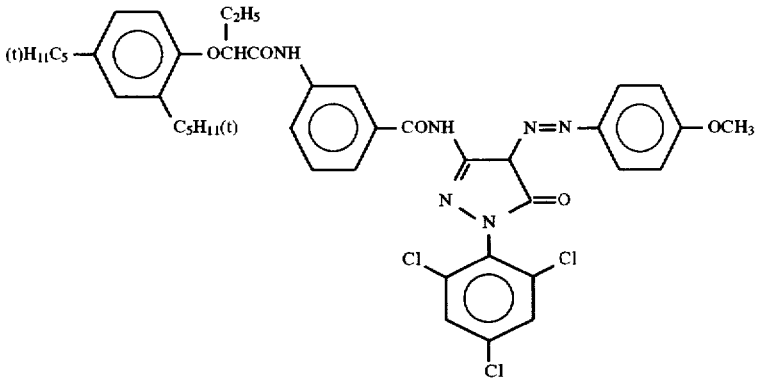
ExM-2
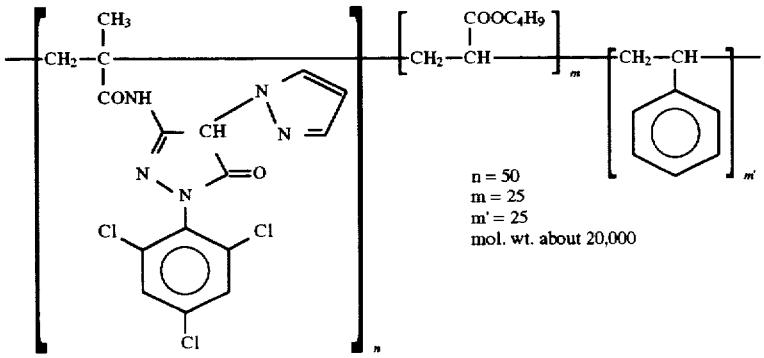
ExM-3
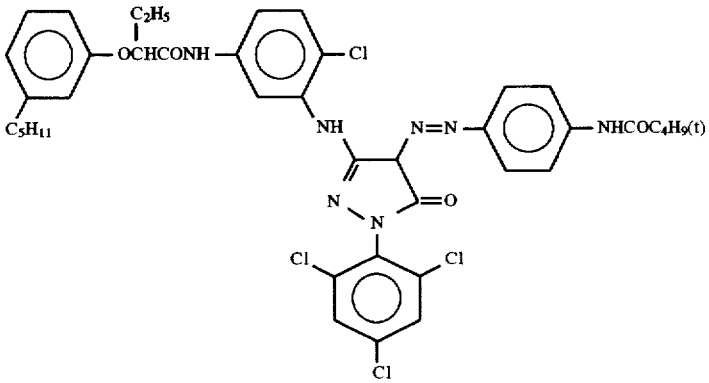

-continued
ExM-4
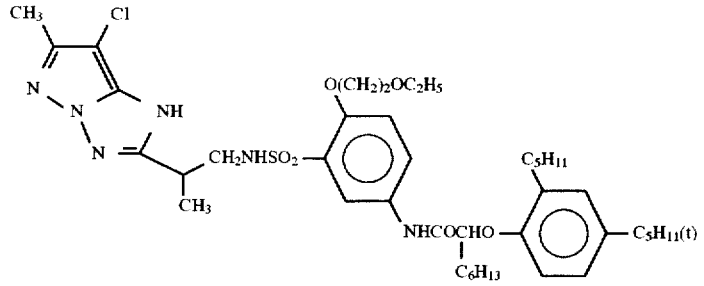
ExM-5
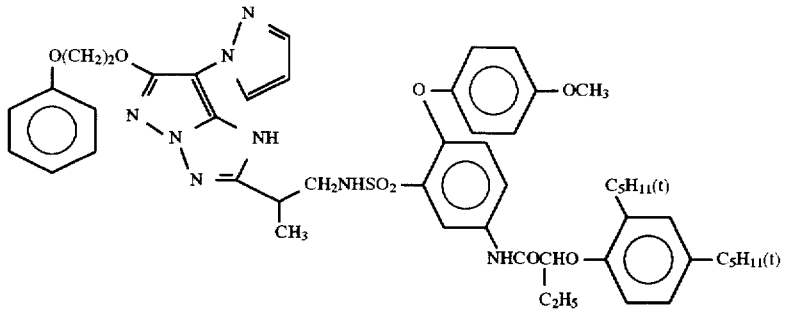
ExY-1
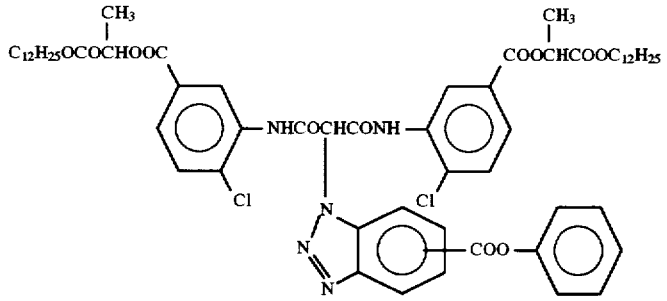
ExY-2
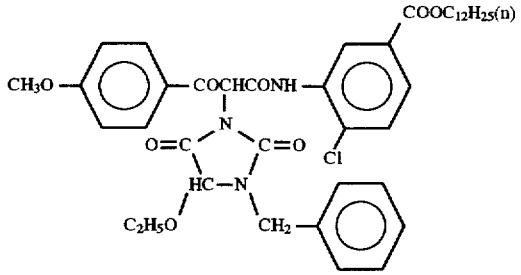
ExY-3
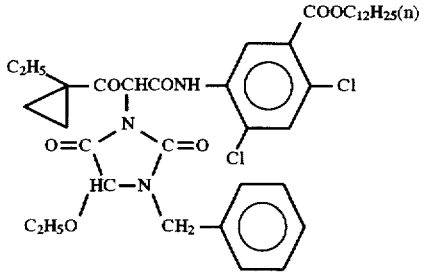

-continued
ExY-4
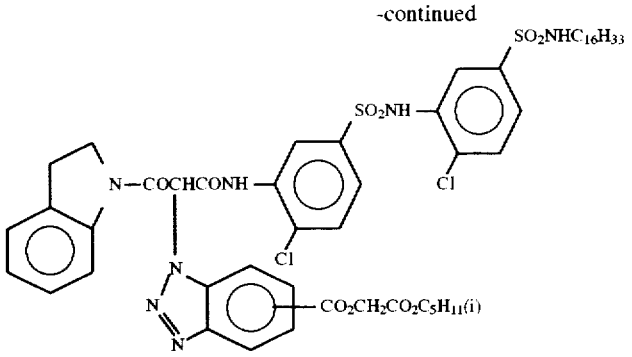
ExY-5
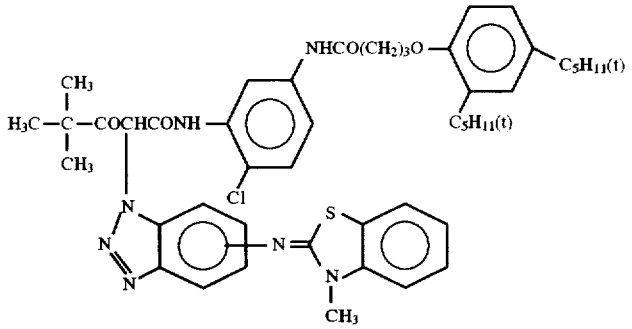
ExF-1
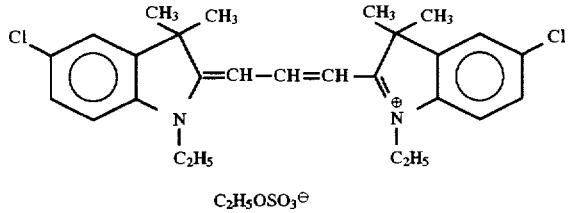
ExF-2
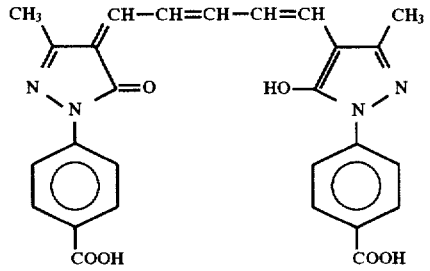
ExF-3
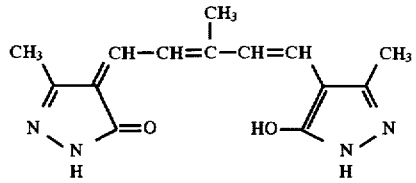
ExF-4
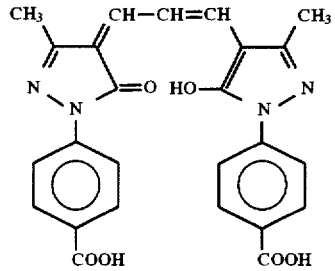

-continued
ExF-5
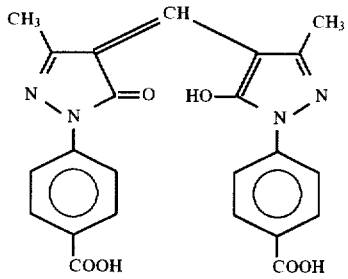
ExF-6
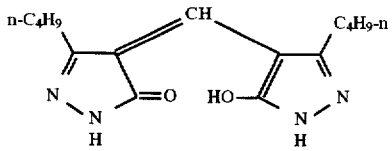
ExF-7
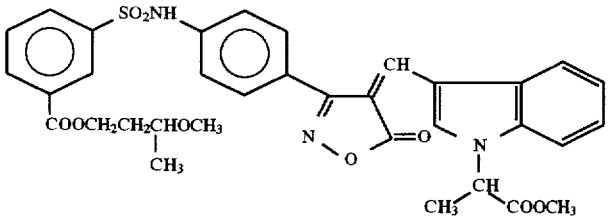
Cpd-1
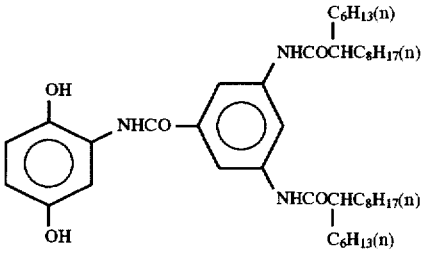
Cpd-2
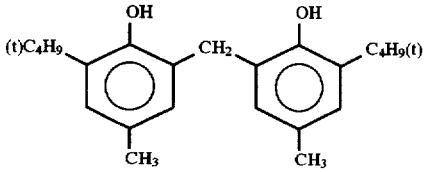
Cpd-3
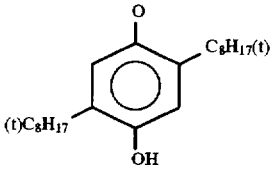
UV-1
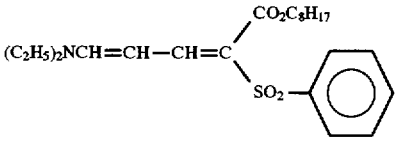
UV-2
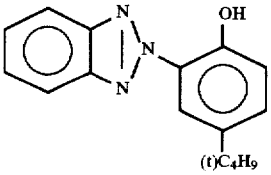

-continued
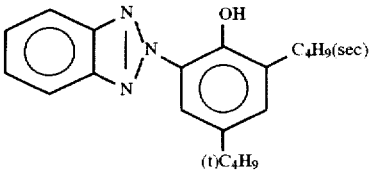
UV-3
Tricresylphosphate HBS-1
Di-n-butylphthalate HBS-2
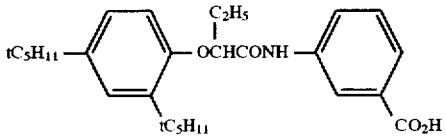
HBS-3
Tri(2-ethylhexyl)phosphate HBS-4
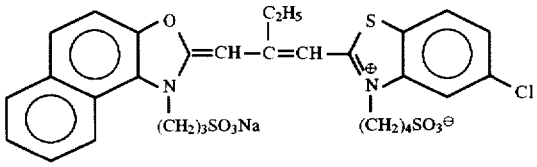
ExS-1
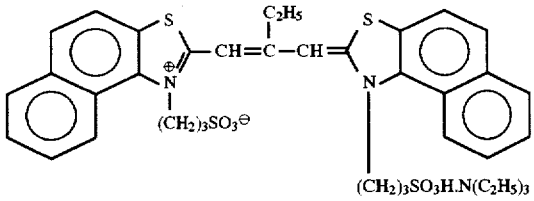
ExS-2
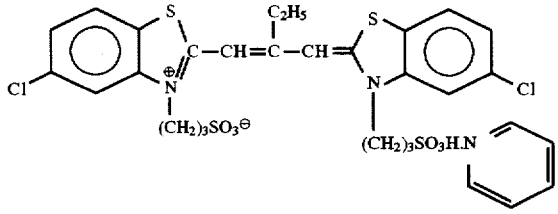
ExS-3
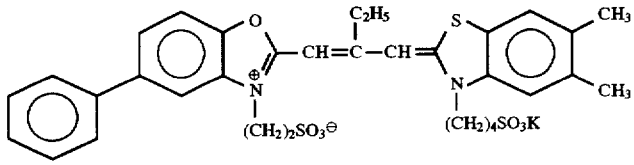
ExS-4
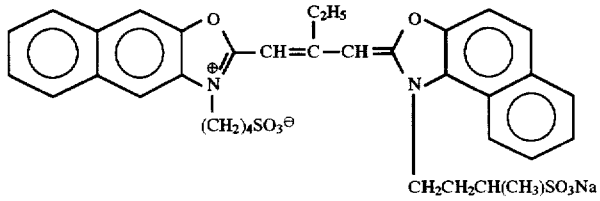
ExS-5
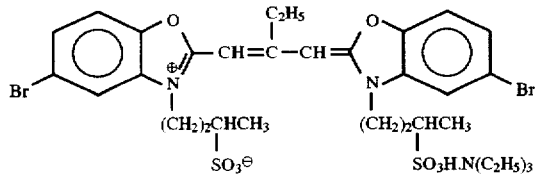
ExS-6

-continued
ExS-7
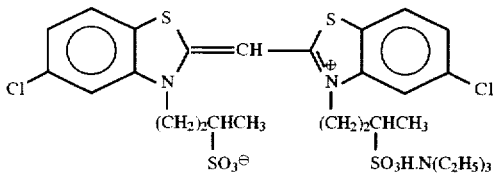
S-1
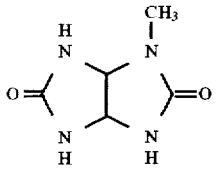
H-1
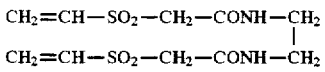
B-1
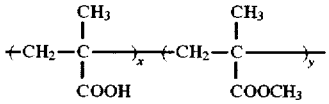
x/y = 10/90 (weight ratio)
overage molecular weight:about 35,000
B-2
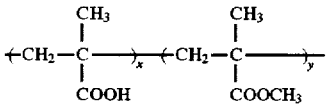
x/y = 40/60 (weight ratio)
overage molecular weight:about 20,000
B-3
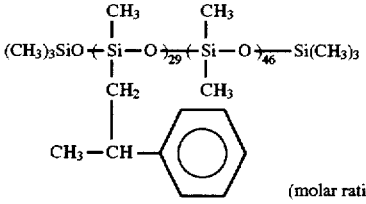
(molar ratio)
overage molecular weight:about 8,000
B-4
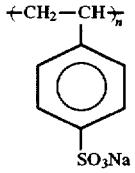
overage molecular weight:about 750,000
B-5
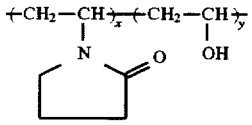
x/y = 70/30 (weight ratio)
overage molecular weight:about 17,000
B-6
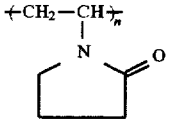
overage molecular weight : about 10,000

-continued
W-1
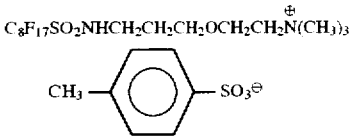
W-2
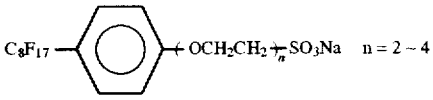
W-3
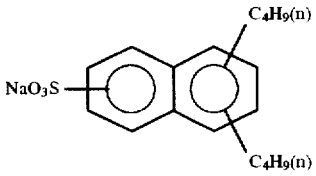
F-1
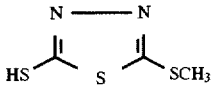
F-2
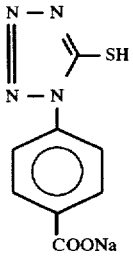
F-3
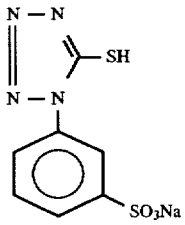
F-4
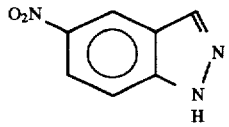
F-5
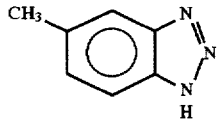
F-6
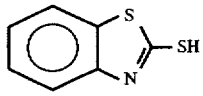
F-7
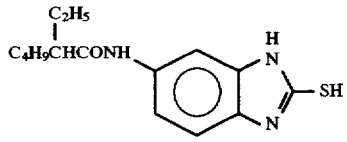

-continued
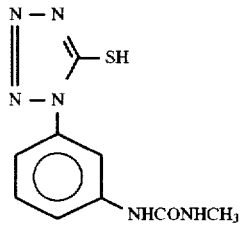
F-8
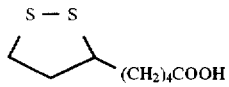
F-9
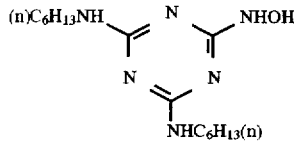
F-10
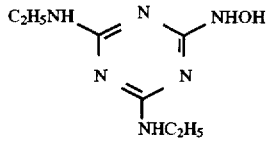
F-11
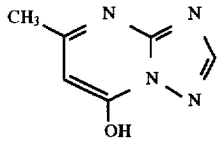
F-12
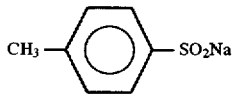
F-13
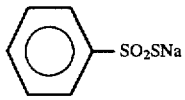
F-14
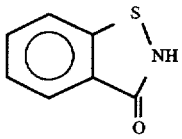
F-15
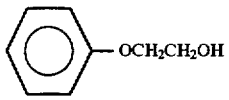
F-16
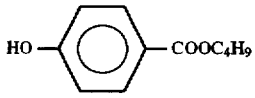
F-17
The contents of the emulsions used in the individual layers are shown in Table 12 below.
TABLE 12
| | | Equivalent-circle diameter (μm) | Thickness (μm) | Total AgI content (mol %) |
|---|---|---|---|---|
| Emulsion | a | 0.28 | 0.07 | 3.1 |
| | b | 0.70 | 0.10 | 3.1 |
| | c | 1.02 | 0.17 | 5.4 |
TABLE 12-continued
| | | Equivalent-circle diameter (μm) | Thickness (μm) | Total AgI content (mol %) |
|---|---|---|---|---|
| | d | 1.26 | 0.18 | 5.4 |
| | e | 0.28 | 0.07 | 3.1 |
| | f | 0.49 | 0.07 | 3.1 |
| | g | 0.70 | 0.10 | 3.1 |
| | h | 1.02 | 0.17 | 5.4 |

TABLE 12-continued

| | Equivalent-circle diameter (μm) | Thickness (μm) | Total AgI content (mol %) |
|---|---|---|---|
| i | 1.26 | 0.18 | 5.4 |
| j | 0.42 | 0.07 | 3.1 |
| k | 0.70 | 0.10 | 5.3 |
| l | 1.33 | 0.19 | 7.0 |
| m | 0.07 | 0.07 | 1.0 |

The emulsions j to l were subjected to reduction sensitization during the preparation of grains by using thiourea dioxide and thiosulfonic acid in accordance with the examples in JP-A-2-191938.

The emulsions a to l were subjected to gold sensitization, sulfur sensitization, and selenium sensitization in the presence of the spectral sensitizing dyes described in the individual light-sensitive layers and sodium thiocyanate in accordance with the examples in JP-A-3-237450. All tabular grains were prepared by using a low-molecular-weight gelatin in accordance with the examples in JP-A-1-158426. Dislocation lines such as described in JP-A-3-237450 were observed in these tabular grains with a high-voltage electron microscope.

The light-sensitive material formed as above was exposed with white light and developed as follows by using an automatic processor FP-360B manufactured by Fuji Photo Film Co., Ltd. Note that FP-360B was modified such that the overflow solution of the bleaching bath was entirely discharged to a waste solution tank without being flowed to the succeeding bath. This FP-360B incorporates an evaporation compensating means described in JIII Journal of Technical Disclosure No. 94-4992.

(Processing steps)

| Step | Time | Temperature | Replenishment rate* | Tank volume |
|---|---|---|---|---|
| Color development | 3 min. 5 sec. | 37.8° C. | 20 ml | 11.5 l |
| Bleaching | 50 sec. | 38.0° C. | 5 ml | 5 l |
| Fixing (1) | 50 sec. | 38.0° C. | — | 5 l |
| Fixing (2) | 50 sec. | 38.0° C. | 8 ml | 5 l |
| Washing | 30 sec. | 38.0° C. | 17 ml | 3 l |
| Stabilization (1) | 20 sec. | 38.0° C. | — | 3 l |
| Stabilization (2) | 20 sec. | 38.0° C. | 15 ml | 3 l |
| Drying | 1 min. 30 sec. | 60.0° C. | | |

*The replenishment rate is represented by a value per 1.1 m of a 35-mm wide sample (equivalent to one 24 Ex. film).

The stabilizer and the fixer were counterflowed from (2) to (1), and the overflow of washing water was entirely introduced to the fixing bath (2). Note that the amounts of the developer, the bleaching solution, and the fixer carried over to the bleaching step, the fixing step, and the washing step were 2.5 ml, 2.0 ml, and 2.0 ml, respectively, per 1.1 m of a 35-mm wide light-sensitive material. Note also that each crossover time was 6 sec, and this time was included in the processing time of each preceding step.

The aperture area of the processor was 100 $cm^2$ for the color developer, 120 $cm^2$ for the bleaching solution, and approximately 100 $cm^2$ for other processing solutions.

The compositions of the processing solutions are presented below.

| (Color developer) | Tank solution (g) | Replenisher (g) |
|---|---|---|
| Diethylenetriamine pentaacetic acid | 3.0 | 3.0 |
| Disodium catechol-3,5-disulfonate | 0.3 | 0.3 |
| Sodium sulfite | 3.9 | 5.3 |
| Potassium carbonate | 39.0 | 39.0 |
| Disodium-N,N-bis(2-sulfonateethyl) hydroxylamine | 1.5 | 2.0 |
| Potassium bromide | 1.3 | 0.3 |
| Potassium iodide | 1.3 mg | — |
| 4-hydroxy-6-methyl-1,3,3a,7-tetrazaindene | 0.05 | — |
| Hydroxylaminesulfate | 2.4 | 3.3 |
| 2-methyl-4-[N-ethyl-N-β-hydroxyethyl)amino] aniline sulfate | 4.5 | 6.5 |
| Water to make | 1.0 l | 1.0 l |
| pH (controlled by potassium hydroxide and sulfuric acid) | 10.05 | 10.18 |

| (Bleaching solution) | Tank solution (g) | Replenisher (g) |
|---|---|---|
| Ferric ammonium 1,3-diaminopropanetetra acetate monohydrate | 113 | 170 |
| Ammonium bromide | 70 | 105 |
| Ammonium nitrate | 14 | 21 |
| Succinic acid | 34 | 51 |
| Maleic acid | 28 | 42 |
| Water to make | 1.0 l | 1.0 l |
| pH (controlled by ammonia water) | 4.6 | 4.0 |

(Fixing (1) tank solution) A 5:95 (volume ratio) mixture of the above bleaching tank solution and the following fixing tank solution.

(pH 6.8)

| (Fixing (2)) | Tank solution (g) | Replenisher (g) |
|---|---|---|
| Aqueous ammonium thiosulfate solution (750 g/l) | 240 ml | 720 ml |
| Imidazole | 7 | 21 |
| Ammonium methane thiosulfonate | 5 | 15 |
| Ammonium methane sulfinate | 10 | 30 |
| Ethylenediamine tetraacetic acid | 13 | 39 |
| Water to make | 1.0 l | 1.0 l |
| pH (controlled by ammonia water and acetic acid) | 7.4 | 7.45 |
| (Washing water) | | |

Tap water was supplied to a mixed-bed column filled with an H type strongly acidic cation exchange resin (Amberlite IR-120B: available from Rohm & Haas Co.) and an OH type strongly basic anion exchange resin (Amberlite IR-400) to set the concentrations of calcium and magnesium to be 3 mg/l or less. Subsequently, 20 mg/l of sodium isocyanuric acid dichloride and 0.15 g/l of sodium sulfate were added. The pH of the solution ranged from 6.5 to 7.5.

| (Stabilizer) | common to tank solution and replenisher (g) |
|---|---|
| Sodium p-toluenesulfinate | 0.03 |
| Polyoxyethylene-p-monononylphenylether (average polymerization degree 10) | 0.2 |
| 1,2-benzoisothiazoline-3-oneysodium | 0.10 |
| Disodium ethylenediaminetetraacetate | 0.05 |
| 1,2,4-triazole | 1.3 |
| 1,4-bis(1,2,4-triazole-l-ylmethyl) piperazine | 0.75 |
| Water to make | 1.0 l |
| pH | 8.5 |

What is claimed is:

1. A silver halide photographic emulsion comprising silver iodobromide tabular grains having (111) faces as parallel major faces and having an aspect ratio of not less than 2 in an amount of not less than 50% of the total projected area of the emulsion, wherein each tabular grain has a core and multi-layered shell structure around the core, wherein said shell structure comprises a first shell on the core, a second shell on the first shell, a third shell on the second shell, and a fourth shell on the third shell, said core having a silver amount of 20 to 50 mol % of the total silver amount in the grain, and an average silver iodide content of 0 to 5 mol % based on the total amount of silver in said core, said first shell having a silver amount of 5 to 30 mol % of the total silver amount in the grain, and an average silver iodide content of 15 to 40 mol % based on the total amount of silver in said first shell, said second shell having a silver amount of 10 to 30 mol % of the total silver amount in the grain, and an average silver iodide content of 0 to 5 mol % based on the total amount of silver in said second shell, said third shell having a silver amount of 1 to 10 mol % of the total silver amount in the grain, and an average silver iodide content of 20 to 100 mol % based on the total amount of silver in said third shell, and said fourth shell having a silver amount of 10 to 40 mol % of the total silver amount of in the grain, and an average silver iodide content of 0 to 5 mol % based on the total amount of silver in said fourth shell.

2. The emulsion according to claim 1, wherein the amount of the silver iodobromide tabular grains is not less than 70%.

3. The emulsion according to claim 1, wherein the aspect ratio is 5 to 20.

4. The emulsion according to claim 1, wherein the variation coefficient of a grain size distribution of the grains is not more than 20%.

5. The emulsion according to claim 1, wherein the total silver iodide content of the emulsion is 5 to 20 mol %.

6. The emulsion according to claim 1, wherein said fourth shell contains 0 mol % of silver iodide based on the total amount of silver in said fourth shell.

7. The emulsion according to claim 6, wherein said second shell contains 0 mol % of silver iodide based on the total amount of silver in said second shell.

8. The emulsion according to claim 6, wherein said third shell contains 100 mol % of silver iodide based on the total amount of silver in said third shell.

9. A silver halide photographic emulsion comprising silver iodobromide tabular grains having (111) faces as parallel major faces and having an aspect ratio of not less than 2 in an amount of not less than 50% of the total projected area of the emulsion, wherein each tabular grain has a core and multi-layered shell structure around the core, wherein said shell structure comprises a first shell on the core, a second shell on the first shell, a third shell on the second shell, and a fourth shell on the third shell, said core having a silver amount of 25 to 45 mol % of the total silver amount in the grain, and an average silver iodide content of 0 to 3 mol % based on the total amount of silver in said core, said first shell having a silver amount of 10 to 25 mol % of the total silver amount in the grain, and an average silver iodide content of 20 to 35 mol % based on the total amount of silver in said first shell, said second shell having a silver amount of 15 to 25 mol % of the total silver amount in the grain, and an average silver iodide content of 0 to 3 mol % based on the total amount of silver in said second shell, said third shell having a silver amount of 1 to 8 mol % of the total silver amount in the grain, and an average silver iodide content of 25 to 100 mol % based on the total amount of silver in said third shell;

said fourth shell having a silver amount of 15 to 35 mol % of the total silver amount in the grain, and an average silver iodide content of 0 to 3 mol % based on the total amount of silver in said fourth shell.

10. The emulsion according to claim 9, wherein the amount of the silver iodobromide tabular grains is not less than 70%.

11. The emulsion according to claim 9, wherein the aspect ratio is 5 to 20.

12. The emulsion according to claim 9, wherein the variation coefficient of a grain size distribution of the grains is not more than 20%.

13. The emulsion according to claim 9, wherein the total silver iodide content of the emulsion is 5 to 20 mol %.

14. The emulsion according to claim 9, wherein said fourth shell contains 0 mol % of silver iodide based on the total amount of silver in said fourth shell.

15. The emulsion according to claim 14, wherein said second shell contains 0 mol % of silver iodide based on the total amount of silver in said second shell.

16. The emulsion according to claim 15, wherein said third shell contains 100 mol % of silver iodide based on the total amount of silver in said third shell.

* * * * *